US011279528B2

(12) United States Patent
Davies

(10) Patent No.: US 11,279,528 B2
(45) Date of Patent: Mar. 22, 2022

(54) CONTAINER CAP AND COMPOUNDS

(71) Applicant: LYVECAP LLC, Sacramento, CA (US)

(72) Inventor: Yinka Davies, Sacramento, CA (US)

(73) Assignee: LYVECAP LLC, Sacramento, CA (US)

( * ) Notice: Subject to any disclaimer, the term of this patent is extended or adjusted under 35 U.S.C. 154(b) by 0 days.

(21) Appl. No.: 16/712,504

(22) Filed: Dec. 12, 2019

(65) Prior Publication Data

US 2021/0221571 A1 Jul. 22, 2021

Related U.S. Application Data

(63) Continuation of application No. 29/706,749, filed on Sep. 23, 2019, now Pat. No. Des. 923,476.

(51) Int. Cl.

| | |
|---|---|
| ***B65D 41/34*** | (2006.01) |
| ***B65D 41/62*** | (2006.01) |
| ***B65D 47/12*** | (2006.01) |

(52) U.S. Cl.

CPC ..... *B65D 41/3428* (2013.01); *B65D 41/62* (2013.01); *B65D 47/121* (2013.01); *B65D 2401/20* (2020.05); *B65D 2401/35* (2020.05)

(58) Field of Classification Search

CPC .. B65D 41/3428; B65D 41/62; B65D 47/121; B65D 2401/35; B65D 2401/20; B65D 51/2835; B65D 51/285; B65D 51/2878; B65D 51/2814

USPC ..... 220/288, 255.1, 502, 212, 203.08, 220/521–522; 215/227–228, DIG. 8; 222/80, 83, 145.1, 145.5, 153.06–153.07, 222/522, 531, 544; 206/219–222, 568

See application file for complete search history.

(56) References Cited

U.S. PATENT DOCUMENTS

| | | | | | |
|---|---|---|---|---|---|
| D120,464 | S | | 5/1940 | Martin | |
| D250,467 | S | | 12/1978 | O'Banion | |
| D258,311 | S | | 2/1981 | Peterson | |
| D292,673 | S | | 11/1987 | Woodruff | |
| 4,781,484 | A | * | 11/1988 | Goncalves | B65D 51/2835 401/132 |
| 4,962,852 | A | * | 10/1990 | Affaitati | B65D 51/2814 206/222 |
| D336,042 | S | | 6/1993 | Bondanza | |
| 5,246,142 | A | | 9/1993 | Dipalma | |

(Continued)

*Primary Examiner* — Chun Hoi Cheung
*Assistant Examiner* — Brijesh V. Patel

(57) ABSTRACT

A cap for accommodating a compound includes a body with an opening. The opening penetrates from an upper to a lower end portion of the body by a first length. A membrane seals a lower end portion of the opening. A lid is removably coupled and moveable relative to the body. The lid includes a protrusion extending downwardly from an interior surface of the lid by a second length greater than the first length. The opening accommodates a lower end portion of the protrusion. A spacer removably couples with the lid and interposes between the lid and the body. The spacer configurable between a first state in which the spacer is engaged with the lid, which prevents the protrusion from penetrating the membrane, and a second state in which the spacer is disengaged with the lid, which allows the protrusion of the lid to penetrate the membrane of the body.

10 Claims, 11 Drawing Sheets

(56) References Cited

U.S. PATENT DOCUMENTS 5,884,759 A * 3/1999 Gueret ..... B65D 81/3211 206/222
6,003,728 A 12/1999 Elliott
D459,653 S 7/2002 Marks
6,840,373 B2 * 1/2005 Gibler ..... B65D 51/2842 206/219
6,921,087 B2 * 7/2005 Takahashi ..... B65D 51/2878 206/219
7,546,919 B2 * 6/2009 Lee ..... B65D 51/2864 206/217
7,568,576 B2 * 8/2009 Sweeney, Jr. ..... B65D 51/2864 206/219
D604,608 S 11/2009 Lourenco
7,614,496 B2 * 11/2009 Dvorak ..... B65D 41/3428 206/219
7,748,550 B2 * 7/2010 Cho ..... B65D 51/285 215/228
7,886,899 B2 * 2/2011 Frutin ..... B65D 51/2892 206/221
8,215,481 B1 7/2012 Knickerbocker
D666,495 S 9/2012 Biesecker
8,403,131 B2 * 3/2013 Rovelli ..... B65D 51/2835 206/222
8,408,389 B1 * 4/2013 Anderson ..... B65D 51/2835 206/222
8,485,353 B2 * 7/2013 Lee ..... B65D 47/243 206/221
D690,596 S 10/2013 Logue
8,714,808 B2 * 5/2014 Yamanaka ..... B01F 15/0087 366/130
8,833,577 B2 * 9/2014 Habibi-Naini ..... B65D 50/045 215/200
8,960,424 B1 * 2/2015 Anderson ..... B65D 51/2835 206/222
D729,010 S 5/2015 Logel
D734,150 S 7/2015 Rigel
9,193,517 B2 * 11/2015 Fontana ..... B65D 51/2821
9,242,773 B1 1/2016 Anderson
9,452,870 B1 9/2016 Anderson
9,545,607 B1 1/2017 Thompson
D855,461 S 8/2019 Wu
D879,551 S 3/2020 Byrd
2002/0020636 A1 * 2/2002 Bergamini ..... B65D 51/285 206/219
2004/0020797 A1 2/2004 Fontana
2005/0161348 A1 * 7/2005 Morini ..... B65D 41/3438 206/219
2005/0211579 A1 * 9/2005 Makita ..... B65D 51/2842 206/219
2007/0289663 A1 * 12/2007 Johns ..... B65D 51/2814 141/112
2008/0093326 A1 * 4/2008 Cho ..... B65D 51/285 215/228
2008/0171109 A1 * 7/2008 Hsieh ..... B65D 51/2835 426/80
2008/0202950 A1 8/2008 Anderson
2008/0223741 A1 * 9/2008 Nyambi ..... B65D 51/2835 206/222
2008/0290061 A1 * 11/2008 Seelhofer ..... B65D 51/2835 215/249
2009/0065378 A1 * 3/2009 Maas ..... B01L 3/502 206/219
2009/0139882 A1 * 6/2009 DeJonge ..... B65D 51/2892 206/219
2009/0261000 A1 * 10/2009 Epp ..... B65D 51/2821 206/222
2010/0059394 A1 * 3/2010 Fontana ..... B65D 51/285 206/222
2012/0325697 A1 12/2012 Cho
2013/0092690 A1 * 4/2013 Skakoon ..... A61B 10/0045 220/277
2014/0305818 A1 10/2014 Lee
2015/0217924 A1 8/2015 Cho
2015/0344204 A1 12/2015 Anderson

* cited by examiner

10

10

10

1100

CONTAINER CAP AND COMPOUNDS

CROSS-REFERENCE TO RELATED APPLICATION

This application claims priority to U.S. patent application Ser. No. 29/706,749, entitled "Container Cap," filed Sep. 23, 2019, which is hereby incorporated by reference in its entirety.

TECHNICAL FIELD

The present disclosure relates generally to caps for containers. More particularly, the present disclosure relates to caps including a compound as described herein.

BACKGROUND

Various caps are known for dispensing a compound into a container. Previous caps generally included a lid and a body that substantially form a cap. Within the lid and the body of the cap is the compound, which is selected to dispense into the container. To prevent tampering or contamination of the compound, previous caps are designed for single use, such that a force is required to separate the lid and the body, and therefore dispose a further compound into the cap, such a force is so great as to discourage the user. Furthermore, previous caps required users to perform complex operations to dispense the compound, such as a combination of rotational and translational movements of the lid relative to the body.

Given the above background, what is needed in the art are cap devices that allow for improved operations for dispensing of a compound. In particular, there is a need for enabling a user to utilize a cap device for dispensing a compound into a container with an improved operation, and reusing the cap device for further dispensing operations.

SUMMARY

The present disclosure addresses the above-identified need in the art. In the present disclosure cap devices and methods thereof are provided.

One aspect of the present disclosure provides a cap device for accommodating and dispensing a compound into a container. The cap device includes a body. The body includes an upper end portion, a lower end portion, and an opening. The opening defines a volume for accommodating the compound. Further, the opening penetrates through a central axis of the body by a first length. The opening penetrates from the upper end portion to the lower end portion of the body. A membrane is disposed at a lower end portion of the opening. The membrane includes a diameter greater than a diameter of the opening, such that the membrane seals the lower end portion of the opening. A lid is removably coupled and moveable relative to the upper end portion of the body. The lid includes an upper end portion including an exterior surface and an interior surface. The lid further includes a protrusion extending downwardly from the interior surface of the lid. The protrusion having a second length greater than the first length of the opening of the body. Moreover, a diameter of the protrusion corresponds to the diameter of the opening. As such, the opening of the body accommodates a lower end portion of the protrusion. A spacer removably engages the upper end portion of the lid. The spacer interposes between the upper end portion of the lid and the upper end portion of the body. Moreover, the spacer is configurable between a first state and a second state. In the first state, the spacer engages with the lid, increasing a distance between the upper end portion of the lid and the lower end portion of the opening by the third length. This increase in distance prevents the protrusion from penetrating the membrane, or the seal formed by the membrane. In the second state, the spacer is disengaged with the lid, removing the third length from the distance between the upper end portion of the lid and the lower end portion of the opening. With the spacer disengaged, the protrusion of the lid penetrates the membrane of the body. Accordingly, the compound dispenses from the cap device into the container.

In some embodiments, the body further includes a gate disposed at the lower end portion of the opening. The gate is movable between a first position, in which the gate occupies a first portion of the opening, and a second position, in which the gate occupies a second portion of the opening.

In some embodiments, the gate is internally disposed at the lower end portion of the opening above the membrane.

In some embodiments, a first end portion of the gate is coupled to the lower end portion of the opening, and a second end portion of the gate is free.

In some embodiments, a lower end portion of the protrusion further includes a wedge configured to abut the second end portion of the gate.

In some embodiments, the opening of the body includes a first diameter at an upper end portion of the opening and a second diameter at a lower end portion of the opening. As such, the diameter of the protrusion corresponds to the second diameter of the opening.

In some embodiments, a transition region of the opening from the first diameter to the second diameter occurs over a portion of the first length of the opening.

In some embodiments, the lid and body are moveable relative to a first translational degree of freedom.

In some embodiments, the protrusion further includes a gasket. The gasket interposes between an inner surface of the opening of the body and an outer surface of the protrusion.

In some embodiments, the spacer is integrally formed with the lid. Accordingly, an interface between the spacer and the lid includes a first strength less than a second strength of the spacer and the lid.

In some embodiments, the interface includes a plurality of perforations.

In some embodiments, the interface includes a first thickness less than a second thickness of the spacer and the lid.

In some embodiments, the spacer is a shaft collar.

In some embodiments, the exterior portion of the lid includes a cylindrical portion including a third diameter. Accordingly, the spacer is cylindrical object of the third diameter having a gap at a portion of a circumference of the cylinder forming the spacer. The gap defines a chord length of the cylinder. The chord length of the gap in the first state of the spacer is less than the third diameter. Further, the chord length of the gap in the second state of the spacer is greater than or equal to the third diameter.

In some embodiments, the spacer is elastically deformable, allowing the spacer to transition between states one or more times.

In some embodiments, the diameter of the spacer is in a range of from 85% to 100% of the third diameter.

In some embodiments, an exterior surface of the upper end portion of the body and the interior surface of the upper end portion of the lid include a corresponding mating mechanism.

In some embodiments, the corresponding mating mechanisms of the body and the lid allow the cap device to be configurable between a first state and a second state. In the first state, the body and the lid are free to couple and decouple with each other. In the second state, the body and the lid are prevented from decoupling with each other.

In some embodiments, a transition from the first state to the second state of the cap device is provided through a relative rotational movement of the lid.

In some embodiments, the second state of the cap restricts the relative movement of the lid by one translational degree of freedom.

In some embodiments, the first state restricts a relative movement of the lid to one translational degree of freedom and one rotational degree of freedom. Further, the second state restricts a relative movement of the lid to the one translational degree of freedom.

In some embodiments, the compound includes a fluid, a solid, a granulate, and/or a combination thereof.

Another aspect of the present disclosure provides a method of dispensing a dosage of a compound accommodated in a cap device of a container. The cap device includes a body including an opening. The cap device further includes a lid including a hollow protrusion and a spacer removably coupled to an upper end portion of the lid. The spacer interposes between the upper end portion of the lid and the body. Accordingly, the method includes sealing a lower end portion of the opening of the body with a membrane. Either of the opening or the hollow of the protrusion is filled with the dosage of the compound. The lid and the body of the cap device couple by accommodating the hollow protrusion of the lid within the opening of the body, such that the compound is accommodated in the cap device. A lower end portion of the body and the container are coupled, such that the cap device is coupled to the container. The spacer is removed from the upper end portion of the lid. The lid is depressed further towards to the body, forcing the protrusion to pierce the seal formed by the membrane. Accordingly, the dosage of the compound is dispensed into the container.

In some embodiments, an internal surface of one of the opening or the hollow protrusion of the cap device further includes a plurality of indicia. Each respective indicia defines a unique predetermined dosage. Accordingly, the filling includes filling the one of the opening or the hollow protrusion to one of the indicia of the plurality of indicia with the compound.

In some embodiments, the coupling further includes coupling the spacer to the upper end portion of the lid.

In some embodiments, the spacer is coupled to the upper end portion of the lid prior to coupling the lid and the body.

In some embodiments, the coupling allows a relative movement between the lid and the body with one translational degree of freedom.

In some embodiments, the coupling allows a relative movement between the lid and the body with the one translational degree of freedom and one rotational degree of freedom. Further, prior to the removing, the one translational degree of freedom of the relative movement between the lid and the body is restricted to one direction.

In some embodiments, the coupling allows a relative movement between the lid and the body with one translational degree of freedom.

In some embodiments, a force required for the coupling is less than or equal to a force required for piercing of the depressing.

In some embodiments, the method further includes decoupling the cap device from the container. Accordingly, in some embodiments, the method further includes repeating the sealing through the depressing of the method for either a second dosage of the dispensed compound or a dosage of a second compound.

In some embodiments, the decoupling further includes decoupling the body and the lid of the cap.

In some embodiments, the sealing of the repeating includes removing the pierced membrane from the lid and sealing with a second membrane different from the first membrane.

In some embodiments, the sealing of the repeating includes resealing the lower end portion of the opening of the body with the membrane, thereby reforming the pierced seal.

In some embodiments, the repeating omits the removing.

In some embodiments, the spacer is integrally formed with the upper end portion of the lid. Accordingly, the method further includes decoupling both the body from the container and the lid from the body. Further, in some embodiments, the method includes repeating the sealing through the depressing of the method with a second lid different from the lid of the dispensed compound.

In some embodiments, the container includes a consumable liquid. Accordingly, prior to the decoupling of either of the body from the container or the lid from the body, the method further includes consuming a solution including and/or comprising the consumable liquid and the compound.

Yet another aspect of the present disclosure provides a cap device for accommodating and dispensing a compound into a container. The cap device includes a body. The body includes an upper end portion, a lower end portion, and an opening. The opening penetrates through an axis of the body by a first length from the upper end portion to the lower end portion of the body. A membrane is disposed at a lower end portion of the opening. The membrane includes a diameter greater than a diameter of the opening, such that the membrane seals the lower end portion of the opening. A lid is removably coupled and moveable relative to the upper end portion of the body. The lid includes an upper end portion including an exterior surface and an interior surface. The lid further includes a protrusion extending downwardly from the interior surface of the lid. The protrusion having a second length greater than the first length of the opening of the body. Moreover, a diameter of the protrusion corresponds to the diameter of the opening. As such, the opening of the body accommodates a lower end portion of the protrusion. A spacer is removably coupled to the upper end portion of the lid and interposes between the upper end portion of the lid and the upper end portion of the body. The spacer is configurable between a first state and a second state. In the first state, the spacer is engaged with the lid, increasing a distance between the upper end portion of the lid and the lower end portion of the opening by the third length, preventing the protrusion from penetrating the membrane. In the second state, the spacer is disengaged with the lid, removing the third length from the distance between the upper end portion of the lid and the lower end portion of the opening, allowing the protrusion of the lid to penetrate the membrane of the body and dispense the compound into the container.

Yet another aspect of the present disclosure provides a cap device for accommodating and dispensing a compound into a container. The cap device includes a body. The body includes an upper end portion, a lower end portion, and an opening. The opening penetrates through an axis of the body by a first length from the upper end portion to the lower end portion of the body. A membrane is disposed at a lower end portion of the opening. The membrane includes a diameter greater than a diameter of the opening, such that the membrane seals the lower end portion of the opening. A lid is removably coupled and moveable relative to the upper end portion of the body. The lid includes an upper end portion including an exterior surface and an interior surface. The lid further includes a protrusion extending downwardly from the interior surface of the lid. The protrusion having a second length greater than the first length of the opening of the body. As such, the opening of the body accommodates a lower end portion of the protrusion. A spacer is configurable between a first state and a second state. In the first state, the spacer is engaged with the lid, increasing a distance between the upper end portion of the lid and the lower end portion of the opening by the third length, preventing the protrusion from penetrating the membrane. In the second state, the spacer is disengaged with the lid, removing the third length from the distance between the upper end portion of the lid and the lower end portion of the opening, allowing the protrusion of the lid to penetrate the membrane of the body and dispense the compound into the container.

BRIEF DESCRIPTION OF THE DRAWINGS

The embodiments disclosed herein are illustrated by way of example, and not by way of limitation, in the figures of the accompanying drawings. Like reference numerals refer to corresponding parts throughout the drawings.

DESCRIPTION OF EMBODIMENTS

Figure 1:
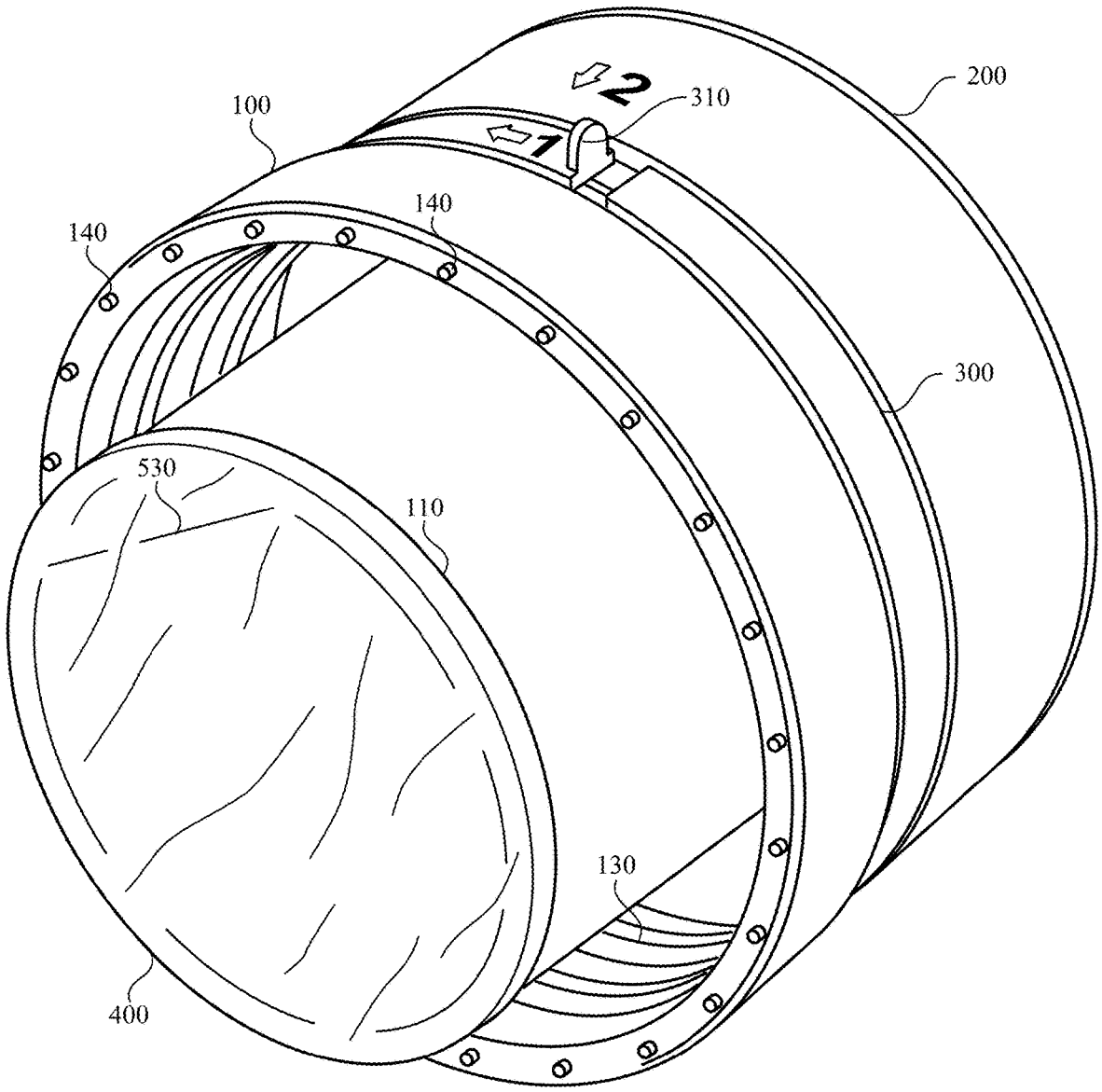
FIG. 1 illustrates a perspective view of a cap device, in accordance with an embodiment of the present disclosure.

The present disclosure provides cap devices that accommodate a compound and dispense the compound into a container. The cap devices include a spacer, that either allows or inhibits the cap device from dispensing the compound. If the spacer allows the user to dispense the compound, the cap device is operated with an improved, simple operation by the user. The improved user operation allows for the dispensing of the compound with minimal user input, such as requiring no rotational movement. Furthermore, the improved user operation allows the user to disengage and reengage various portions of the cap device together without exerting a significant force. This allows for further containers and/or compounds to be utilizable by the cap device, allowing the user to reuse a cap device and conduct multiple dispensing operations over a time period, in some embodiments with the same cap device.

A cap for accommodating a compound includes a body with an opening. The opening extends downwardly from an upper end portion to a lower end portion of the body by a first length. A membrane seals a lower end portion of the opening. A lid is removably coupled and moveable relative to the body. The lid includes a protrusion extending downwardly from an interior surface of the lid by a second length. This second length is greater than or equal to the first length. The opening accommodates a lower end portion of the protrusion, which in combination with the membrane further accommodates the compound within the cap device. A spacer removably couples with the lid and engages with the lid interposing between the lid and the body. A first state of the spacer includes the spacer engaging with the lid, which prevents the protrusion from penetrating the membrane. A second state of the spacer includes the spacer disengaged from the lid, which allows the protrusion of the lid to penetrate the membrane of the body. As such, a user dispenses the compound by disengaging the spacer and the lid, allowing the lid to depress downwardly and penetrate the membrane.

Reference will now be made in detail to embodiments, examples of which are illustrated in the accompanying drawings. In the following detailed description, numerous specific details are set forth in order to provide a thorough understanding of the present disclosure. However, it will be apparent to one of ordinary skill in the art that the present disclosure may be practiced without these specific details. In other instances, well-known methods, procedures, components, circuits, and networks have not been described in detail so as not to unnecessarily obscure aspects of the embodiments.

Plural instances may be provided for components, operations or structures described herein as a single instance. Finally, boundaries between various components are somewhat arbitrary, and particular operations are illustrated in the context of specific illustrative configurations. Other forms of functionality are envisioned and may fall within the scope of the implementation(s). In general, structures and functionality presented as separate components in the example configurations may be implemented as a combined structure or component. Similarly, structures and functionality presented as a single component may be implemented as separate components. These and other variations, modifications, additions, and improvements fall within the scope of the implementation(s).

It will also be understood that, although the terms "first," "second," etc. may be used herein to describe various elements, these elements should not be limited by these terms. These terms are only used to distinguish one element from another. For example, a first compound could be termed a second compound, and, similarly, a second compound could be termed a first compound, without departing from the scope of the present disclosure. The first compound and the second compound are both compounds, but they are not the same compound.

Furthermore, when a reference number is given an "$i^{th}$" denotation, the reference number refers to a generic component, set, or embodiment. For instance, an indicium termed "indicium i" refers to the $i^{th}$ indicium in a plurality of indicia (e.g., an indicia 800-*i* in a plurality of indicia 800).

The terminology used herein is for the purpose of describing particular embodiments only and is not intended to be limiting of the claims. As used in the description of the embodiments and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The foregoing description, for purpose of explanation, has been described with reference to specific embodiments. However, the illustrative discussions below are not intended to be exhaustive or to limit the embodiments to the precise forms disclosed. Many modifications and variations are possible in view of the above teachings. The embodiments are chosen and described in order to best explain the principles and their practical applications, to thereby enable others skilled in the art to best utilize the embodiments and various embodiments with various modifications as are suited to the particular use contemplated.

In the interest of clarity, not all of the routine features of the embodiments described herein are shown and described. It will be appreciated that, in the development of any such actual implementation, numerous implementation-specific decisions are made in order to achieve the designer's specific goals, such as compliance with use case- and business-related constraints, and that these specific goals will vary from one implementation to another and from one designer to another. Moreover, it will be appreciated that such a design effort might be complex and time-consuming, but nevertheless be a routine undertaking of engineering for those of ordering skill in the art having the benefit of the present disclosure.

For convenience in explanation and accurate definition in the appended claims, the terms "upper," "lower," "up," "down," "upwards," "downwards," "laterally," "longitudinally," "inner," "outer," "inside," "outside," "inwardly," "outwardly," "interior," "exterior," "front," "rear," "back," "forwards," and "backwards" are used to describe features of the exemplary embodiments with reference to the positions of such features as displayed in the figures.

Referring to FIG. 1 through FIG. 10, a cap device 10 is illustrated in accordance with various embodiments of the present disclosure. The cap device 10 is configured to removably engage with a container. Containers of the present disclosure include drinkware, such as glassware, and laboratory ware. For instance, in some embodiments, a container includes a beaker, a bottle, a drinking glass such as a tumbler, a flask, a jar, a tube, and the like. Once engaged with the container, the cap device 10 and the container are dis-engagable, allowing the cap device 10 to be reused with any number of a variety of containers.

In some embodiments, the cap device 10 accommodates one or more compounds (e.g., compound 700 of FIG. 5) within a portion of the cap device 10. By transitioning the cap device 10 between various states (e.g., from a first state of FIG. 5 to a second state of FIG. 6), a compound 700 accommodated within the cap device 10 is dispensed into the container. In some embodiments, the container accommodates a solvent (e.g., a potable fluid such as water) and the compound 700 includes a material that is soluble in the solvent of the container. Accordingly, upon dispensing the compound 700 from the cap device 10 into the container (e.g., method 1100 of FIG. 11), a solution forms. In some embodiments, the solution is a consumable (e.g., potable) solution for a user of the cap device 10.

The compound 700 includes a variety of materials including one or more fluids materials, one or more solid materials, or a combination thereof. For instance, in some embodiments, the compound 700 includes one or more concentrated liquids, one or more pastes, one or more granulated solids, one or more emulsions, or the like. In some embodiments, the compound 700 is a consumable compound, such as a material that provides one or more physiological benefits upon consumption by a user. Consumable compounds 700 include pharmaceutical compounds, nutritional compounds such as vitamins and minerals, organic compounds, and the like. In some embodiments, the compound 700 includes one or more prebiotics, with each prebiotic including one or more respective populations of bacteria. In some embodiments, the compound 700 includes an active material (e.g., an active ingredient in a pharmaceutical composition).

The cap device 10 includes a body 100 and a lid 200 that removably engage with each other, allowing a user to repeatedly disposed a compound 700 into, or similarly dispense the compound 700 from, the cap device 10. In some embodiments, this repeated use (e.g., engagement and disengagement of the lid 200 and the body 100) of the cap device 10 allows the user to utilize the same body 100 and/or the same lid 200 for more than one dispensing operation (e.g., block 1116 of the method 1100 of FIG. 11). Furthermore, having the body 100 and the lid 200 removably engage with each other allows the cap device 10 to be utilized with a variety of containers and/or a variety of compounds 700 in multiple dispensing processes, improving the utility of the cap device 10.

In some embodiments, the cap device 10 is configured to engage with a predetermined container, or a predetermined size of a container (e.g., a predetermined mouth size of a container, such as a 40 millimeter (mm) standard mouth container). In some embodiments, the body 100 portion of the cap device 10 is configured to engage with a predetermined container, or a predetermined size of a container, whereas the lid 200 portion of the body is a generic component configured to engaging with a sized body 100. For instance, in some embodiments, a first cap device 10-1 is configured using a first body 100-1 and a first lid 200-1 while a second cap device 10-2 is configured using a second body 100-2 and a second lid 200-2. Moreover, in some embodiments, the first cap device 10-1 is configured using the first body 100-1, the second body 100-2, the first lid 200-1, the second lid 200-2, or a combination thereof (e.g., the cap device 10 allows for interchangeable components). As such, in some embodiments, the present disclosure provides cap devices 10 suitable for a variety of containers and/or components of various cap devices 10 (e.g., bodies 100 and/or lids 200).

Figure 4A:
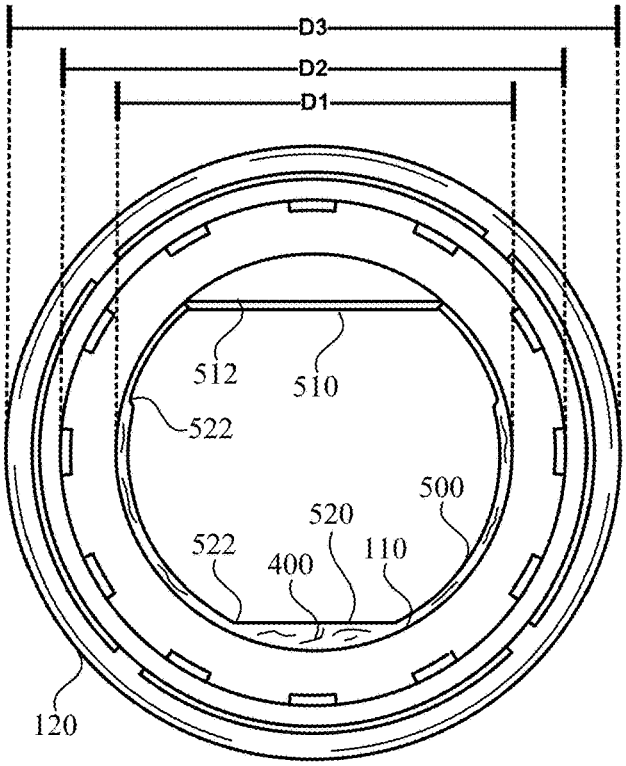
FIG. 4A illustrates a top view of a body of a cap device, where dashed lines are projections of a corresponding length, in accordance with an embodiment of the present disclosure.
Figure 4B:
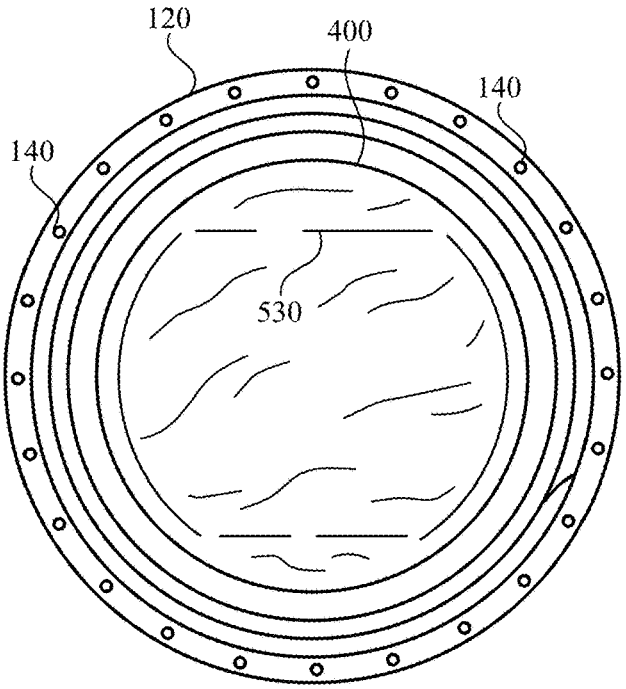
FIG. 4B illustrates a bottom view of a body of a cap device, in accordance with an embodiment of the present disclosure.
Figure 5:
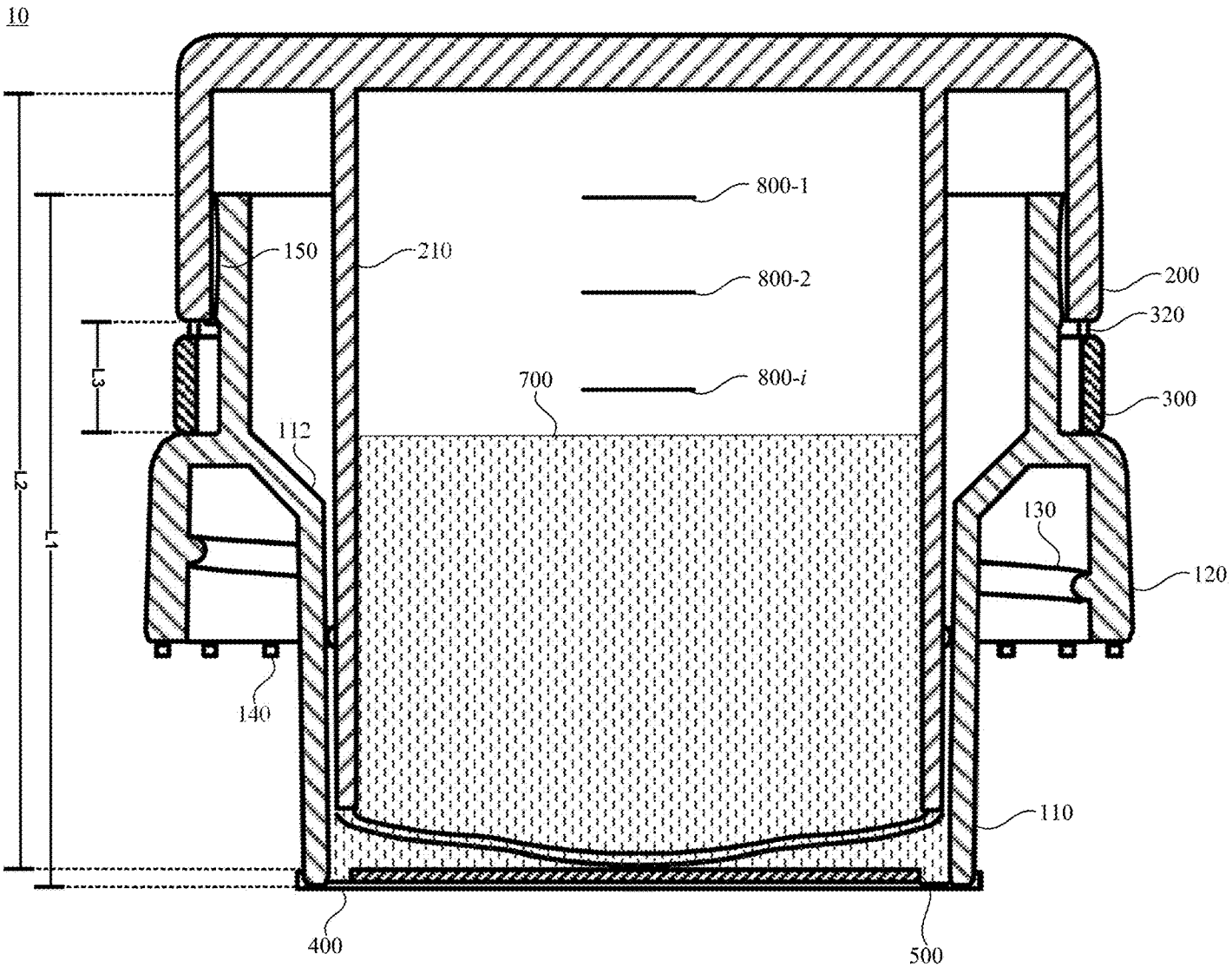
FIG. 5 illustrates a cross-sectional view of a cap device in a first state, where dashed lines are projections of a corresponding length, in accordance with an embodiment of the present disclosure.

As illustrated in FIG. 1 through FIG. 10, in some embodiments, an external surface of the cap device 10 includes a cylindrical shape, allowing the cap device 10 to be grasped by a user. For instance, in some embodiments, each edge or lip of the external surface of the cap device 10 includes a rounded of chamfered edge. Moreover, and as described in more detail infra, in some embodiments, the external surface of the cap device 10 includes a slope, such that the external surface of the cap device 10 is formed in a shape of a cone. However, the present disclosure is not limited thereto as one skilled in the art will know of other configurations of the external surface of the cap device 10 within the present disclosure. Collectively, the body 100 and the lid 200 form an internal cavity that accommodates the compound 700 within the cap device 10. In some embodiments, the internal cavity includes a portion of an opening 110 of the body 100 and/or a portion of a protrusion 210 that extends downwardly from a surface of the lid 200. For instance, as illustrated in FIG. 5, in some embodiments, the internal cavity that accommodates the compound 700 includes an internal portion (e.g., a hollow) of the protrusion 210 and/or a lower end portion of the opening 110.

The opening 110 is disposed at an upper end portion of the body 100, and configured to accommodate a portion of the lid 200 (e.g., a portion of the protrusion 210). In some embodiments, the opening 110 is formed as a through hole that spans from the upper end portion to the lower end portion of the body 100. For instance, referring briefly to FIG. 4A, a top view of the body 100 illustrates a through hole for the opening 110, which is sealed at a lower end portion by a membrane (e.g., membrane 400 of FIG. 10) and partially obstructed by a gate (e.g., gate 500 of FIG. 10). Accordingly, the through hole opening 110 allows the compound 700 to pass from the upper end portion to the lower end portion of the body 100 by the force of gravity alone.

The opening 110 has a first length (e.g., length L1 of FIG. 5) that defines a distance from an upper end portion to a lower end portion of the opening 110. In some embodiments, the first length L1 of the opening 110 is in a range of from 5 millimeters (mm) to 60 mm, from 5 mm to 55 mm, from 10 mm to 55 mm, from 15 to 55 mm, from 15 mm to 50 mm, from 20 mm to 50 mm, from 25 mm to 50 mm, from 25 mm to 45 mm, from 30 mm to 45 mm, from 30 mm to 40 mm, from 32 mm to 38 mm, or 34 mm to 36 mm. In some embodiments, the first length L1 of the opening 110 is 34.5±0.4 mm (e.g., 34.66 mm).

In some embodiments, the opening 110 defines a volume for accommodating the compound 700, such as a maximum volume, a dosage volume, and the like. In some embodiments, the volume defined by the opening 110 is a volume of the internal cavity of the cap device 10. For instance, in some embodiments, the volume of the opening 110 is a function of the first length L1 of the opening 110 and a diameter (e.g., D1 of FIG. 5) of the opening 110. The opening 110 penetrates through an axis (e.g., axis 160 of FIG. 6) of the body 100 spanning from a first end portion to a second end portion of the body 100, allowing a fluid (e.g., compound 700) or free flowing material (e.g., a granulated solid) to pass from the first end portion through the body 100 and exit via the second end portion of the body 100. In some embodiments, the first end portion of the body 100 includes a side surface of the body 100 or the upper end portion of the body 100. Similarly, in some embodiments, the second end portion of the body 100 includes the side surface of body 100 or the lower end portion of the body 100. In some embodiments, the axis 160 is a central axis from the upper end portion to the lower end portion of the body 100. However, the present disclosure is not limited thereto. For instance, in some embodiments, the opening 110 includes one or more internal curves that redirect a path through the opening 110.

In some embodiments, the cap device 10 further includes one or more indicia (e.g., indicia 800-1 of FIG. 5) that identify various features of the cap device 10. In some embodiments, one or more of the indicia 800 is disposed within the internal cavity of the cap device 10, such as on an internal surface of the opening 110 and/or an internal portion (e.g., hollow) of the protrusion 210. In some embodiments, each respective indicia 800 defines a unique predetermined dosage of a compound 700, such as a unique predetermined volume. In some embodiments, each unique predetermined volume of a corresponding indicia 800 is in a range of from 0.5 milliliters (mL) to 25 mL, from 1 mL to 25 mL, from 1 mL to 20 mL, from 1 mL to 15 mL, from 1 mL to 10 mL, from 2 mL to 10 mL, or from 4 mL to 6 mL (e.g., 5 mL). In some embodiments, each unique predetermined volume of a corresponding indicia 800 is a corresponding portion of the volume of the internal cavity (e.g., a first indicia 800-1 indicates a portion of ten percent of the volume of the internal cavity, a second indicia 800-2 indicates a portion of fifteen percent of the volume of the internal cavity, a third indicia 800-3 indicates a portion of twenty percent of the volume of the internal cavity, etc.). While the illustrated embodiments of the indicia 800 disposed internally within the cap device 10 are illustrated as dashed lines, the present disclosure is not limited thereto as one skilled in the art will recognize that other such representations of the indicia 800 are within the realm of the present disclosure.

Figure 8:
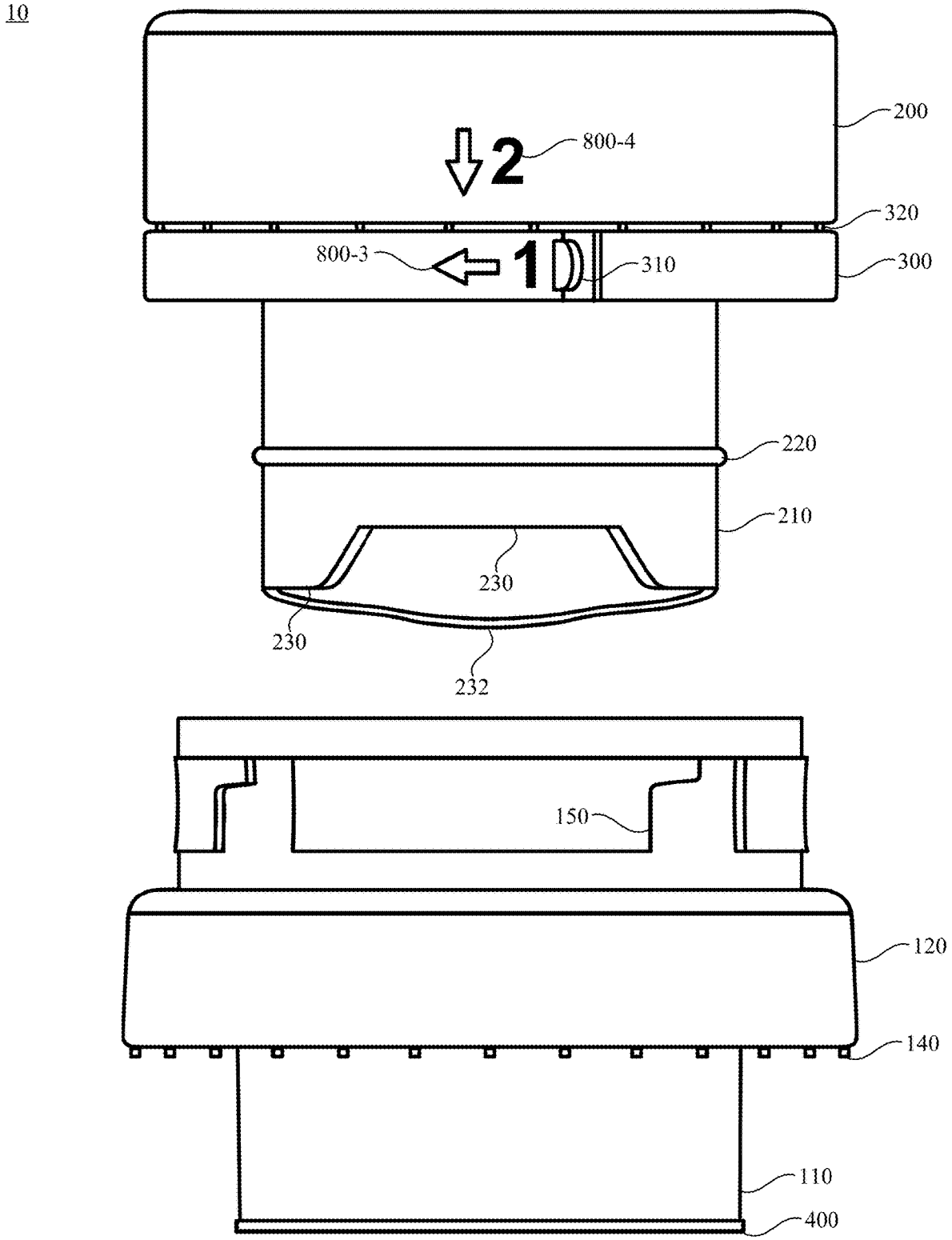
FIG. 8 illustrates a first partially exploded side view of a cap device, in accordance with an embodiment of the present disclosure.
Figure 9:
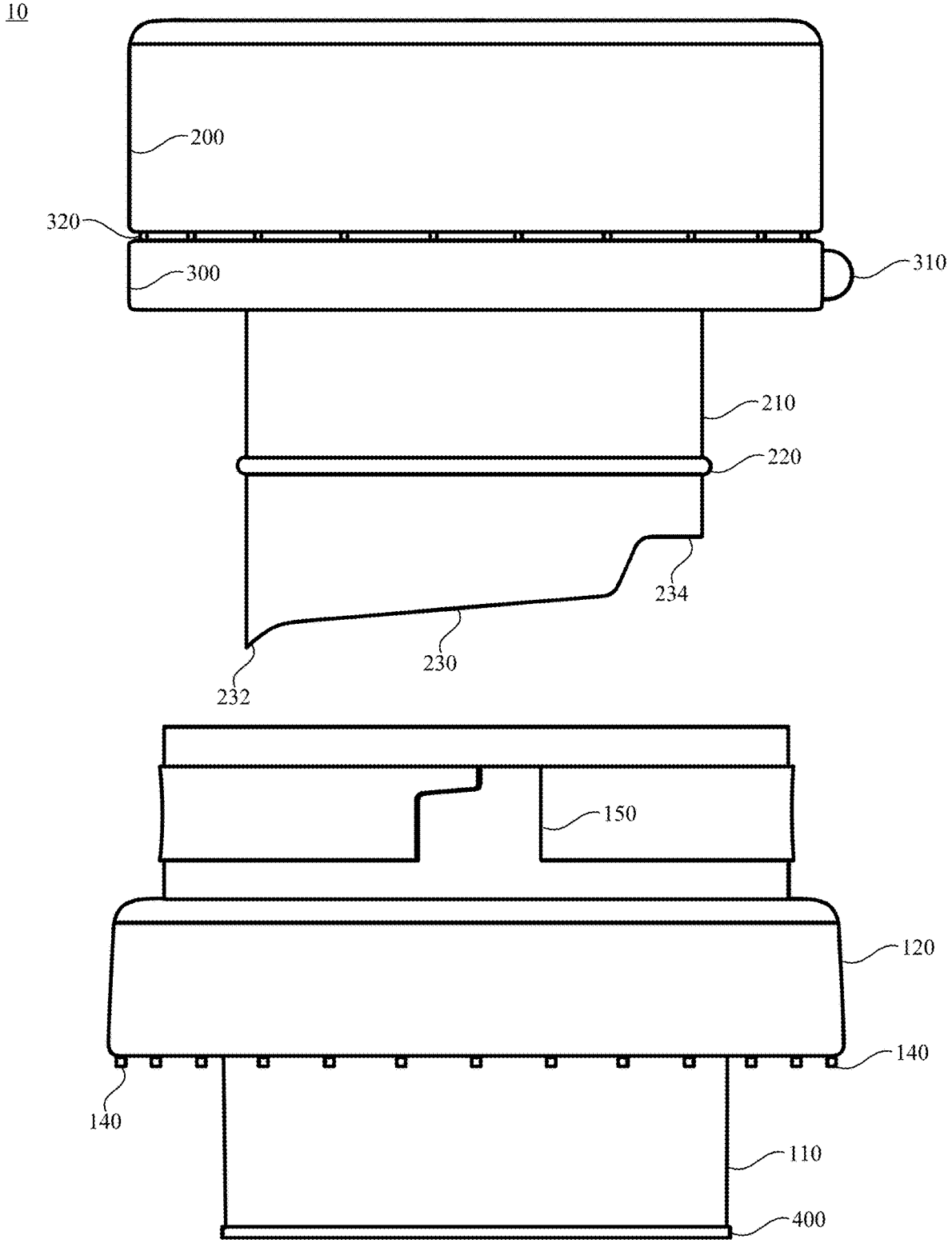
FIG. 9 illustrates a second partially exploded side view of a cap device, in accordance with an embodiment of the present disclosure.

Furthermore, in some embodiments, the external surface of the cap device 10 includes one or more indicia 800 (e.g., indicia 800-4 of FIG. 8) that each identify a degree of freedom of motion of the cap device 10. For instance, in some embodiments, an external surface of a spacer (e.g., spacer 300 of FIG. 8) of the cap device 10 includes a third indicia 800-3 identifying a direction of motion of a corresponding degree of freedom of the spacer 300. Similarly, in some embodiments, an external surface of the lid 200 of the cap device 10 includes a fourth indicia 800-4 that identifies a direction of motion of a corresponding degree of freedom of the spacer 300, which in this illustrated embodiment of FIG. 8 is a first translational degree of freedom. In some embodiments, one or more of the external indicia 800 includes a first identifier illustrating the corresponding degree of freedom (e.g., an arrow), a second identifier illustrating a corresponding operation in a series of orders of operations (e.g., method 1100 of FIG. 11) for utilizing the cap device (e.g., an numerical number and/or a letter), or a combination thereof. For instance, the third indicia 800-3 includes a corresponding first identifier "⇦" identifying a clockwise direction and a corresponding second identifier "1" identifying a first operation in an order of operations (e.g., block 1112 of method 1110 FIG. 11). Moreover, the fourth indicia 800-4 includes a corresponding first identifier "⇩" identifying a downward (e.g., depressing) direction and a corresponding second identifier "2" identifying a second operation in an order of operations (e.g., block 1112 of FIG. 11).

Furthermore, in some embodiments, the one or more one or more of the external indicia 800 includes a fifth indicia (e.g., fifth indicia 800-5 of FIG. 2), that identifies a relative orientation of the body 100 with respect to the lid 200. For instance, in some embodiments, the fifth indicia 800-5 is disposed on a portion of the body 100 (e.g., an external surface of a skirt 120). As such, in some embodiments, the relative orientation of the fourth indicia 800-4 of the lid 200 and the fifth indicia 800-5 of the body 100 allows a user of the cap device 10 to determine an orientation of the protrusion 210 within the opening 110 of the body 100 within needing to visible inspect the protrusion 210 (e.g., align a wedge portion 230 of the protrusion 210 with a gate 500 of the cap device 10). In some embodiments, alignment of the fourth indicia 800-4 of the lid 200 and the fifth indicia 800-5 of the body 100 allows the cap device to transition from a first state to a second state (e.g., from a first state of FIG. 5 to a second state of FIG. 6), such that the cap device 10 is preventing from transitioning to the second state if at least the fourth indicia 800-4 of the lid 200 and the fifth indicia 800-5 are unaligned (e.g., and a spacer 300 is engaged with the cap device 10).

In some embodiments, the opening 110 of the body 100 is formed in a cylindrical shape (e.g., a cylinder with straight walls, a cone with sloped walls, etc.) that includes a first diameter (e.g., D1 of FIG. 4A). In some embodiments, the first diameter D1 is a diameter as measured from an internal surface of the opening 110, as measured from an external surface of the opening 110, or as measured from a mean thickness of a wall (e.g., a wall forming the external and internal surfaces) of the opening 110. Moreover, in some embodiments, the first diameter D1 spans a length of the opening 110, allowing the opening 110 to form at least a partially cylindrical shape. In some embodiments, the length of the opening 110 having the first diameter D1 is an entire length of the opening 110 (e.g., first length L1 of FIG. 5). In some embodiments, the length of the opening 110 having the first diameter D1 is a portion of the entire length L1 of the opening 110, such as a lower end portion of the opening 110. In some embodiments, the first diameter D1 of the opening 110 is in a range of from 5 mm to 50 mm, from 5 mm to 45 mm, from 10 mm to 45 mm, from 10 mm to 40 mm, from 10 mm from 35 mm, from 10 mm to 35 mm, from 15 mm to 35 mm, from 20 mm to 40 mm, from 20 mm to 35 mm, from 25 mm to 40 mm, from 25 mm to 35 mm, from 28 mm to 35 mm, from 28 mm to 33 mm, from 30 mm to 35 mm, from 30 mm to 33 mm, from 31 mm to 32 mm, from 27 mm to 33 mm, or from 29 mm to 32 mm (e.g., 30 mm). In some embodiments, the first diameter D1 of the opening 110 is 31.5±0.4 mm (e.g., 31.43 mm).

Accordingly, in some embodiments, the opening 110 includes a second diameter (e.g., D2 of FIG. 4A) that is different from the first diameter D1 of the opening 110. In some embodiments, the second diameter D2 is greater than the first diameter D1 of the opening 110. However, the present disclosure is not limited thereto. In some embodiments, the second diameter D2 is disposed at an upper end portion of the opening 110. Furthermore, in some embodiments, the second diameter D2 of the opening is greater than a diameter of the protrusion 210 of the lid 200, which allows for improved (e.g., easier) accommodation of the protrusion 210 into the opening 110 of the body 100. In some embodiments, the second diameter D2 of the opening 110 is in a range of from 10 mm to 75 mm, from 15 mm to 75 mm, from 20 mm to 75 mm, from 20 mm to 65 mm, from 25 mm to 65 mm, from 25 mm to 60 mm, from 25 mm to 55 mm, from 20 mm to 50 mm, from 25 mm to 50 mm, from 30 mm to 45 mm, from 35 mm to 40 mm, or from 37 mm to 39 mm (e.g., 38 mm). In some embodiments, the second diameter D2 of the opening 110 is 38.5±0.4 mm (e.g., 38.56 mm).

In some embodiments, the opening 110 includes the first diameter D1 and the second diameter D2, with a transition region (e.g., transition region 112 of FIG. 5) interposing between the first diameter D1 and the second diameter D2 (e.g., a region transitioning from the first diameter D1 to the second diameter D2). In some embodiments, a lower end portion of an exterior portion of the transition region 112 abuts a portion of the container (e.g., a spout or a mouth of the container) if the cap device 10 and the container are engaged with each other. In some embodiments, the transition region 112 spans a length of the opening 112. In some embodiments, the length of the transition region 112 includes an entire length of the opening 110 (e.g., first length L1 of FIG. 5), such that the opening 110 is formed in a shape of a truncated sphere or cone (e.g., a frustum). In some embodiments, the transition region 112 includes a linear slope and/or a smooth curve (e.g., parabolic curve), such that the transition region 112 provides a smooth transition from the first diameter D1 to the second diameter D2, allowing for improved accommodation of the protrusion 210 of the lid 200 into the opening 110 of the body 100. Furthermore, in some embodiments, the transition region 112 funnels a flow of the compound 700, allowing for improved disposal and/or dispensing of the compound 700. For instance, in some embodiments, the opening 110 includes a slope (e.g., a portion of transition region 112) at a predetermined angle from the axis 160. In some embodiments, the predetermined angle of the opening 110 is in a range of from −0.1 degrees (°) to −15°, from −0.5° to −15°, from −0.5° to −10°, from −0.5° to −7.5°, from −0.5° to −5°, from −0.5° to −3°, from −1° to −3°, or from −1° to −2°. In some embodiments, the predetermined angle of the opening 110 is −1±0.4° (e.g., −1.2°).

Furthermore, in some embodiments, one or more indicia 800 are associated with the transition region 112. For instance, in some embodiments, a first indicia 800-1 is associated with a first portion of the body 100 at and/or above the transition 112, a second indicia 800-2 is associated with a second portion of the body 100 at the transition 112, a third indicia 800-3 is associated with a third portion of the body 100 at and/or below the transition 112, or a combination thereof.

One skilled in the art will recognize that, while the present disclosure is described in terms of diameters and circular cross-sectional areas, the present disclosure is not limited thereto. For instance, in some embodiments, each of the describe openings and/or components of the cap device 10 (e.g., opening 110 of body 100, protrusion 210 of lid 200, etc.) and their corresponding diameters are instead formed as a cross-sectional area of any polygon with a characteristic length equal to the corresponding described diameter (e.g., instead of the first diameter D1 of the opening 110 having a circular cross-section with a diameter of 1 centimeter (cm) the first diameter D1 of the opening 110 has a square cross-section with a similar length and width of 1 cm).

In some embodiments, the body 100 includes a skirt 120 that protrudes outwardly from an exterior surface of the body. The skirt 120 provides a region of the body 100 for receiving a portion of a container, such as a mouth of the container. In some embodiments, the skirt 120 is disposed at the upper end portion of the body 100, the lower end portion of the body 100, or interposing between the upper end portion and the lower end portion of the body 100. Moreover, in some embodiments, the skirt 120 protrudes outwardly from the external surface of the opening 110. Further, in some embodiments, the skirt 120 is disposed protruding outwardly from a portion of the opening including the transition region 112. In some embodiments, the skirt 120 extends outwardly from the external surface of the opening 110 by a distance (e.g., a difference between D3 and either of D1 or D2 of the opening 110 of FIG. 4A) in a range of from 1 mm to 30 mm, from 1 mm to 25 mm, from 1 mm to 20 mm, from 2 mm to 20 mm, from 1 mm to 15 mm, from 2 mm to 15 mm, from 2 mm to 10 mm, from 5 mm to 15 mm, from 5 mm to 10 mm, or from 6 mm to 8 mm. In some embodiments, the skirt 120 extends outwardly from the external surface of the opening 110 by a distance of 7.75±0.4 mm (e.g., 7.83 mm). Moreover, in some embodiments the external surface opposing the internal surface of the skirt 120 includes a slope at a predetermined angle from the axis 160. In some embodiments, the predetermined angle of the skirt 120 is in a range of from 0.5° to 25°, from 0.5° to 25°, from 0.5° to 20°, from 0.5° to 15°, from 0.5° to 10°, from 1° to 10°, from 1° to 7.5°, from 1° to 6°, from 2° to 6°, or 3° to 5°. In some embodiments, the predetermined angle of the skirt 120 is 4±0.4° (e.g., 4.05°).

Figure 11:
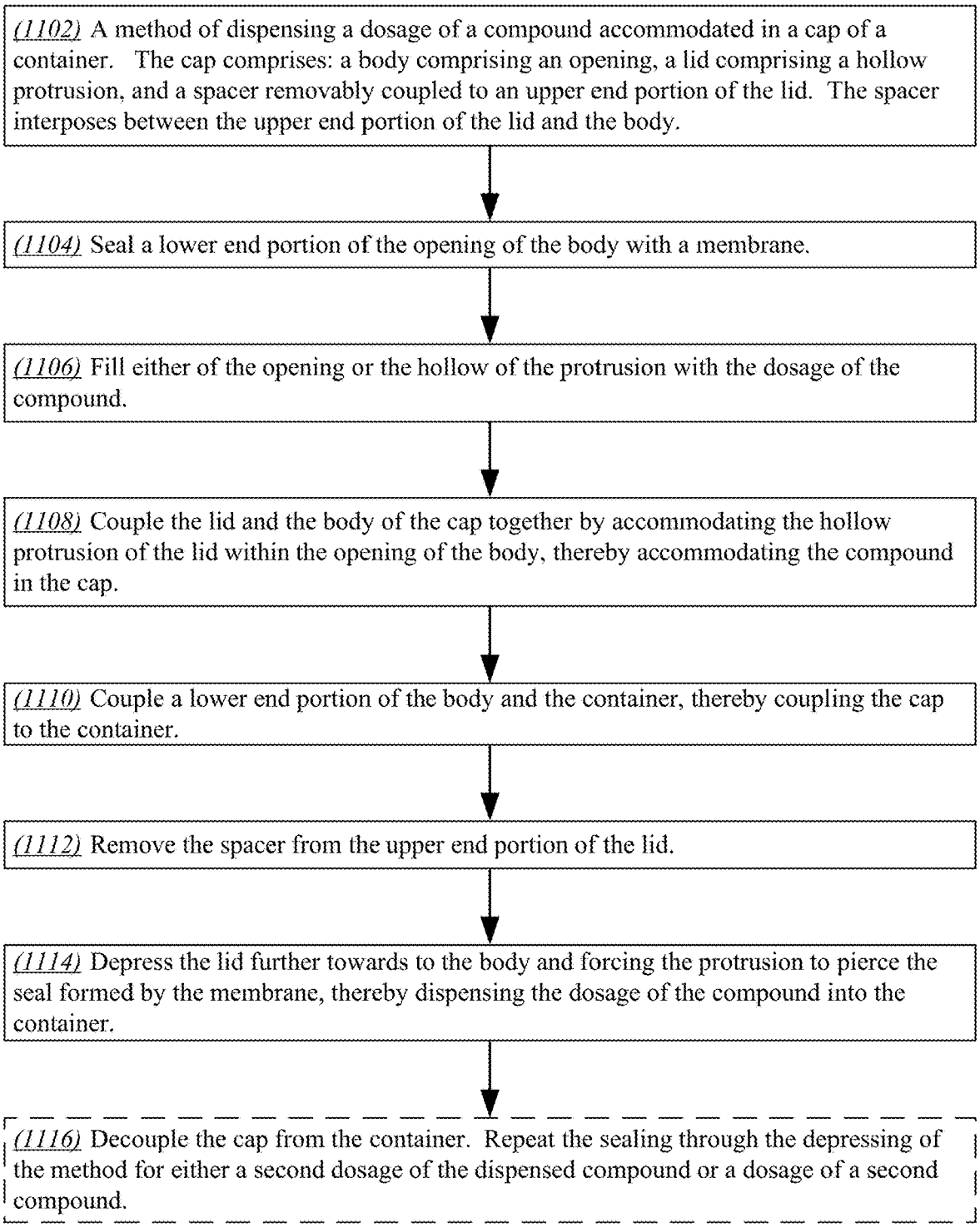
FIG. 11 provides a flow chart of processes and features of a cap device for accommodating and dispensing a compound into a container, where dashed boxes are optional, in accordance with an exemplary embodiment of the present disclosure.

Furthermore, in some embodiments, the body 100 includes a mating mechanism (e.g., first mating mechanism 130 of FIG. 1) that facilitates removably engaging the cap device 10 and the container together (e.g., block 1110 of FIG. 11). In some embodiments, the container includes a corresponding first mating mechanism that engages with the first mating mechanism 130 of the body 100. For instance, in some embodiments, the first mating mechanism 130 of the body 100 includes a female mating mechanism and the corresponding first mating mechanism of the container includes a corresponding male mating mechanism. Similarly, in some embodiments, an opposite female-male configuration is employed for the first mating mechanism 130. Likewise, in some embodiments, the first mating mechanism 130 of the body 100 includes an internal mating mechanism (e.g., an inwardly facing mechanism such as internal threads) and the corresponding first mating mechanism of the container includes a corresponding external mating mechanism (e.g., an outwardly facing mechanism such as external threads). In some embodiments, the first mating mechanism 130 of the body 100 is configured to mate with a predetermined corresponding mating mechanism of the container, such as a predetermined container with a standard mouth (e.g., 55 mm to 70 mm diameter mouth) or wide mouth (e.g., 70 mm to 90 mm diameter mouth) container. In some embodiments, the first mating mechanism 130 of the body 100 is a continuous thread mating mechanism, such that a full relative rotation of the lid 200 about the body 100 is required to disengage and engage the lid 200 and the body 100 together. In some embodiments, the first mating mechanism 130 of the body 100 is a lug thread mating mechanism, such that a partial relative rotation of the lid 200 about the body 100 is required to disengage and engage the lid 200 and the body 100 together.

In some embodiments, the skirt 120 of the body 100 includes the first mating mechanism 130 for engaging (e.g., fastening) the body 100 to the container. In some embodiments, the first mating mechanism 130 of the skirt 120 is disposed on an internal surface of the skirt 120, such that the corresponding first mating mechanism of the container is accommodated by a portion of the skirt 120, maintaining sanitation of the container. In some embodiments, the first mating mechanism 130 of the skirt 120 includes an interference mating mechanism (e.g., a press fit or friction fit mating mechanism), such as a latch mechanism or a pin mechanism.

As illustrated in FIG. 5, in some embodiments, the opening 110 extends downwardly past a lower end portion of the skirt 120. For instance, in some embodiments, the opening 110 extends downwardly past one or more protrusions of the skirt 120 (e.g., protrusions 140). Accordingly, in some embodiments, the opening 110 extends downwardly past the first mating mechanism 130 of the skirt 120. As such, upon engaging the cap device 10 with the container, the lower end portion of the opening 110 is received by a portion the container and extends into an internal cavity of the container past the corresponding first mating mechanism of the container. This receiving of the opening 110 into the cavity of the container allows for the compound 700 to dispense from the cap device 10 into the container 100 with a reduced risk of residual portions of the compound 700 remaining at the neck and/or mouth of the container (e.g., the compound 700 is dispensed directly into a solvent of the container). Moreover, having the opening 110 extend downwardly past the lower end portion of the skirt 120 allows for improved inspection of the membrane 400 and/or viewing of the dispensing of the compound 700 from the cap device 10.

Further, in some embodiments, the skirt 120 includes a plurality of protrusions 140, each of which extends downwardly from a lower end portion of the skirt 120. In some embodiments, the protrusions 140 engage with an external surface of the container, such as a portion of the neck of the container. The engagement of the protrusions 140 with the surface of the container increases a surface area of the body 100 in contact with the container, which increases an amount of force required to disengage the body 100 from the container. For instance, in some embodiments the protrusions 140 restrict a movement of the body 100 relative to the container if a user engages a lid (e.g., lid 200 of FIG. 1) of the cap device 10. Furthermore, in some embodiments, one or more of the protrusions 140 impart one or more indicia (e.g., a marking such as an imprint and/or a scratch) on a portion of the container, which acts as evidence that the cap device 10 was coupled to the container (e.g., evidence of tampering, use, etc.). In some embodiments, the protrusions 140 include one or more perforations (e.g., embodiments of one or more perforations of interface 320 of FIG. 2), such that a second spacer couples with the cap device 10. In some embodiments, the protrusions 140 include a number of protrusions in a range of from 2 to 150, from 3 to 150, from 4 to 150, from 5 to 150, from 10 to 150, from 10 to 100, or from 20 to 50. In some embodiments, each protrusion 140 extends from the lower end portion of the skirt 120 by a distance in a range of from 0.01 mm to 10 mm, from 0.01 mm to 5 mm, from 0.05 mm to 3 mm, from 0.1 mm to 3 mm, from 0.1 mm to 2 mm, from 0.1 mm to 1 mm, or from 0.3 mm to 0.7 mm. In some embodiments, each protrusion 140 extends from the lower end portion of the skirt 120 by a distance of 0.5±0.4 mm (e.g., 0.50 mm).

As described above, the lid 200 of the cap device 10 removably engages with the body 100, allowing respective compounds 700 to be repeatedly disposed and accommodated within the cap device 10 (e.g., block 1106 of FIG. 11) for dispensing (e.g., block 1114 of FIG. 11). The lid 200 includes an upper end portion including an exterior surface (e.g., one or more surfaces of FIG. 3A) and an interior surface (e.g., one or more surfaces of FIG. 3B). In some embodiments, an upper end portion of the exterior surface (e.g., surfacing including logo 240 of FIG. 3A) includes a planar portion that provides a substantially flat (e.g., within an acceptable tolerance such as ±1 mm) surface for a user of the cap device 10 to apply a force (e.g., an applied force for depressing the lid 200 further towards a portion of the body 100, such as block 1114 of FIG. 11), allowing for a reduced force for the user to apply. For instance, in some embodiments, the planar portion of the upper end portion of the exterior surface is parallel to a plane of the first state of the gate 500, or intersects the plane of the first state of the gate 500.

Figure 3A:
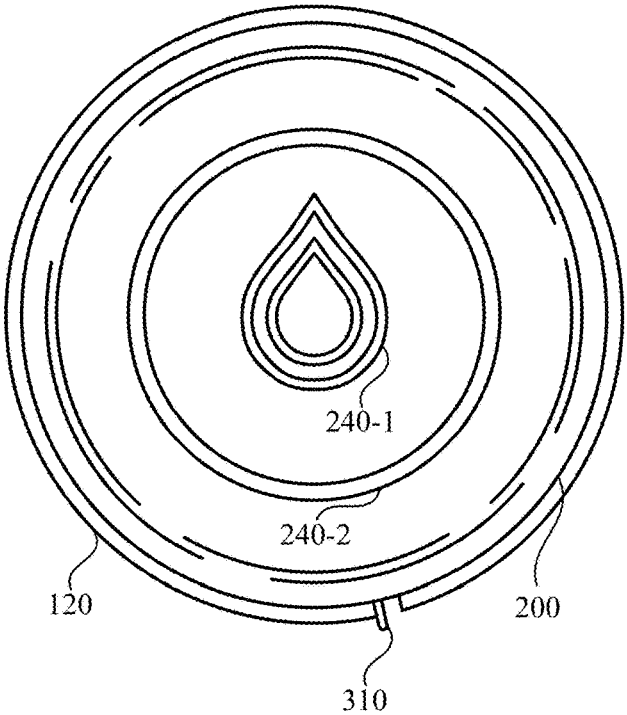
FIG. 3A illustrates a top view of a lid of a cap device, in accordance with an embodiment of the present disclosure.

Referring briefly to FIG. 3A, the exterior surface of the upper end portion of the lid 200, and, in some embodiments, the exterior surfaces of the body 100, allows for great flexibility for fashionable elements. In some embodiments, the exterior surface of the lid 200 includes fashionable elements such as distinctive colors, textures, ornamentation (e.g., marks, logos, etc.), or a combination thereof. For instance, in the illustrated embodiment of FIG. 3A, the exterior surface of the upper end portion of the lid 200 includes ornamentation including a logo 240 or mark (e.g., a fluid droplet 240-1 encompassed in one or more concentric circles or grooves 240-2). However, the present disclosure is not limited thereto. For instance, in some embodiments, a portion of the exterior surface of the upper end portion of the lid 200 includes a transparent or translucent material, allowing for inspection of the contents of the cap device 10 (e.g., inspection of the compound 700 within the internal cavity of the cap device 10) after engaging the body 100 and the lid 200 together.

As described above, the lid 200 further includes the protrusion 210 that extends downwardly from the interior surface of the lid 200. Depending on a state of the cap device 10 (e.g., if the lid 200 and the body 100 are in, or transitioning to, the second state), the protrusion 210 is accommodated within a portion of the opening 110, allowing the protrusion 210 to traverse in a linear direction (e.g., parallel to axis 160) within the opening 110. In accordance with a force provided to the lid 200, the lid 200, and therefore the protrusion 210, is depressed downwardly towards the lower end portion of the opening 110.

The protrusion 210 extends downwardly from the upper end portion of the lid 200 by a second length (e.g., L2 of FIG. 5). An axis that the protrusions extends about includes a central axis of the upper end portion of the lid 200 (e.g., axis 160 of FIG. 5) or an axis offset from the central axis of the upper end portion of the lid 200. In some embodiments, the protrusion 210 is formed as a hollow protrusion, such that the protrusion extends downwards from the upper end portion of the lid 200 in the shape of a circumference of a cylinder, providing an open end portion at a lower end portion of the protrusion 210. However, the present disclosure is not limited thereto. For instance, in some embodiments, the protrusion 210 is formed as a solid cylindrical object with a closed end portion of the lower end portion of the protrusion 210. This cylindrical configuration allows the protrusion 210 to reduce an internal volume of the interval cavity of the cap device 10 while depressing the lid 200.

In some embodiments, the second length L2 of the protrusion 210 is greater than or equal to the first length L1 of the opening 110 of the body 100. In some embodiments, the second length L2 of the protrusion 210 is in a range of from 10 mm to 75 mm, from 15 mm to 75 mm, from 20 mm to 75 mm, from 20 mm to 70 mm, from 25 mm to 70 mm, from 25 mm to 65 mm, from 30 mm to 65 mm, from 30 mm to 60 mm, from 25 mm to 60 mm, from 25 mm to 55 mm, from 30 mm to 55 mm, from 30 mm to 50 mm, from 35 mm to 50 mm, from 35 mm to 45 mm, or from 40 mm to 45 mm. In some embodiments, the second length L2 of the protrusion 210 is in 42±0.4 mm (e.g., 41.95 mm). In some embodiments, the second length L2 is measured by a distance from an upper end portion of the protrusion 210 (e.g., an interface between the protrusion 210 and the upper end portion of the lid 200), and a portion of the lower end portion of the protrusion (e.g., a mean length of a wedge 230, a first edge 232 of the wedge, a second edge 234 of the wedge 230, etc.).

Moreover, in some embodiments, a diameter of the protrusion 210 corresponds to the diameter of the opening 110 (e.g., diameter D1) of the body 100. For instance, in some embodiments, the diameter of the protrusion 210 is within a predetermined tolerance of the diameter D1 of the opening 110, allowing for the protrusion 210 to be accommodated by the opening 110 with a close, or snug, fit.

In some embodiments, the protrusion 210 of the lid 200 further includes a gasket 220, which forms a seal between the protrusion 210 and the opening 110. If the lid 200 is engaged with the body 100 (e.g., such that the protrusion 210 is accommodated within the opening 110), the gasket 220 interposes between an inner surface of the opening 110 of the body 100 and an outer surface of the protrusion 210 and preventing a departure of the compound 700 through an interface of the protrusion 210 and the opening 110. In some embodiments, the gasket 220 is integrally formed with an exterior surface of the protrusion 210, such that the gasket 220 is formed as an outwardly protrusion of the exterior surface of the protrusion 210. In some embodiments, the gasket 220 includes an O-ring or a closure liner, which provides a seal between the protrusion 210 and the opening 110 of the cap device 10.

In some embodiments, the cap device 10 includes a membrane (e.g., membrane 400 of FIG. 10) that seals a portion of the body 100 (e.g., block 1104 of FIG. 11). For instance, in some embodiments, the membrane 400 is disposed at a lower end portion of the opening 110, sealing the opening 110. In some embodiments, the membrane 400 is integrally formed with a lower end portion of the opening 110 (e.g., the membrane 400 is formed as a thin-walled surface orthogonal to the walls of the opening 110). The membrane 400 includes a diameter greater than the first diameter D1 of the opening 110, allowing the membrane 400 to seal the lower end portion of the opening 110 and couple (e.g., adhere to) an external surface of the opening 110. Moreover, in some embodiments, the diameter of the membrane 400 is greater than an internal diameter of the opening 110 (e.g., D1 of opening 110) and less than or equal to an external diameter of the opening 110.

In some embodiments, a surface of the membrane 400 includes an adhesive material (e.g., glue) or a waxy material that allows for the membrane 400 to removable engage with the lower end portion of the opening 110. In some embodiments, the membrane 400 includes a metal material (e.g., an aluminum foil membrane 400) or a plastic material. The membrane 400 is configured such that a strength of the seal between the membrane 400 and the lower end portion of the opening 110, or similarly a rigidity of the membrane 400, is sufficient to support an applied load of the compound 700, and optionally the gate 500, under gravity. Further, the strength of the seal need also be sufficient to yield to a force applied through the protrusion 210 of the lid 200, such that the seal is capable of being pierced. Furthermore, in some embodiments, the membrane 400 includes a semi-permeable portion. For instance, in some embodiments, the semi-permeable portion of the membrane 400 allows for fluidic communication between an environment and the internal cavity of the cap device 10, such that an internal pressure of the internal cavity of the cap device 10 and an atmospheric pressure are equal.

Additionally, the cap device 10 includes a spacer (e.g., spacer 300 of FIG. 2) disposed at an upper end portion of the lid 200. The spacer 300 interposes between a portion of the lid 200 and a portion of the body 100 (e.g., the upper end portion of the lid 200 and a skirt 120 portion of the body 100), acting as a mechanical stop between the lid 200 and the body 100 of the cap device 10, such as a shaft collar. This spacer 300 is configured to inhibit the cap device 10 from transitioning from a first state (e.g., an engaged state of FIG. 5) in which a portion of the lid 200 and a portion of the body 100 are prevented from traversing to a position of close proximity, and a second state (e.g., a disengaged state of FIG. 6) in which the spacer is disengaged from the cap device 10 allowing the portion of the lid 200 and the portion of the body 100 to traversing to the position of close proximity, and, therefore, pierce a seal of the membrane 400. As such, the spacer 300 is configurable between a first state (e.g., an engaged state of FIG. 5) and a second state (e.g., a disengaged state of FIG. 6). In the first state, the spacer 300 is engaged with the lid cap device 10, increasing a distance between the upper end portion of the lid 200 a portion of the body 100 (e.g., an upper end portion of the skirt 120 of the body 100), such that the lid 200 is arrested by the spacer 300. In the second state, the spacer 300 is disengaged with the lid 200, which removes the third length L3 from the distance between the upper end portion of the lid 200 and the lower end portion of the opening 110 (e.g., block 1112 of FIG. 11). With this removed third length L3 provided by the spacer 300, the protrusion 210 of the lid 200 is allowed to penetrate the membrane 400 of the body 100, which in turn dispenses the compound 700 from the cap device 10 into the container (e.g., block 1114 of FIG. 11).

The spacer 300 includes a third length (e.g., length L3 of FIG. 5). In some embodiments, the third length L3 of the spacer 300 is less than or equal to a length of a portion of the opening having the second diameter D2. In some embodiments, the third length L3 of the spacer 300 is in a range of from 0.5 mm to 20 mm, from 1 mm to 20 mm, from 0.5 mm to 17.5 mm, from 1 mm to 17.5 mm, from 1 mm to 15 mm, from 1 mm to 15 mm, from 1 mm to 10 mm, from 2 mm to 8 mm, from 2.5 mm to 7.5 mm, or from 4 mm to 6 mm (e.g., 5 mm). In some embodiments, the third length L3 of the spacer 300 is 5.0±0.4 mm (e.g., 5.24 mm, 4.73 mm, etc.).

In some embodiments, the spacer 300 includes a mechanism (e.g., mechanism 310 of FIG. 9) that assists the user in engaging and/or disengaging the spacer 300 from the cap device 10 (e.g., block 1112 of FIG. 11). In some embodiments, the mechanism 310 of the spacer 300 includes a protrusion extending outwardly from a surface of the spacer 300. In some embodiments, the protrusion of the mechanism 310 includes a holding portion (e.g., a pull-tab) configured for the user to grasp. In some embodiments, the protrusion of the mechanism 310 includes a planar surface portion (e.g. a raised incline) configured to provide an enlarged area for the user to apply a force for disengaging the spacer 300. In some embodiments, the mechanism 310 is disposed at an end portion of the spacer 300 (e.g., the mechanism 310 of FIG. 1) or at an intermittent portion of the spacer 300. Moreover, in some embodiments, the protrusion of the mechanism 310 is oriented with respect to the logo 240 of the lid 200, such that if the cap device 10 is laid longitudinally on a flat on a surface (e.g., the length L2 of the opening 110 is parallel to a plane of the flat surface), the mechanism 130 arrests the cap device 10 such that the logo 240 is oriented in a direction that is legible to the user, such as an orientation of the mechanism 310 of FIG. 3A. Further, in some embodiments, the mechanism 310 includes one or more of the external indicia (e.g., the mechanism 310 includes the third indicia 800-1) for identifying various features of the cap device 10.

Moreover, in some embodiments, an interface (e.g., interface 320 of FIG. 5) is formed between the spacer 300 and the lid 200. The interface 320 includes a mechanism interface, a magnetic interface, or a combination thereof, that assisting providing a removably engaging spacer 300. In some embodiments, such as the illustrated third length L3 of FIG. 5, the interface 320 is included within the third length L3 of the spacer 300. However, the present disclosure is not limited thereto.

In some embodiments, the spacer 300 is integrally formed with the lid 200. For instance, in some embodiments, the spacer 300 and the lid 200 are formed during an additive manufacturing process (e.g., a three-dimensional printing process, an injection molding process, a vat photopolymerization process, etc.), allowing for the spacer 300 to the lid 200 to be formed as a single integrally formed component. In some embodiments, the integral forming of the spacer 300 and the lid 200 provides the interface 320 with a first material strength that is different from a second strength of the spacer 300 and/or the lid 200, such that a portion of the cap device 10 deforms in accordance with a provided force (e.g., a force required for disengaging the spacer 300 and the lid 200). In some embodiments, difference in strength between the lid 200, the spacer 300, the interface 320, or a combination thereof is provided through a difference in relative materials and/or a difference in physical design (e.g., a difference in material thickness, a deformity, etc.). For instance, in some embodiments, the first strength of the interface 320 is less than the second material strength of the second strength of the spacer 300 and/or the lid 200, allowing for a portion of the interface 320 to fracture under the provided force. In some embodiments, the first strength of the interface 320 is greater than the second material strength of the second strength of the spacer 300, allowing for a portion of the spacer to fracture under the provided force.

Figure 3B:
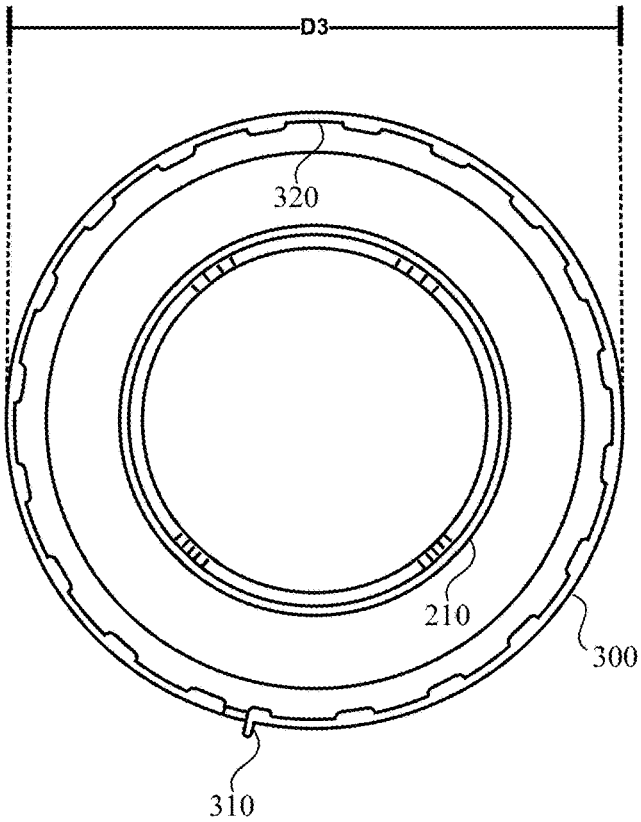
FIG. 3B illustrates a bottom view of a lid of a cap device, in accordance with an embodiment of the present disclosure.
Figure 7:
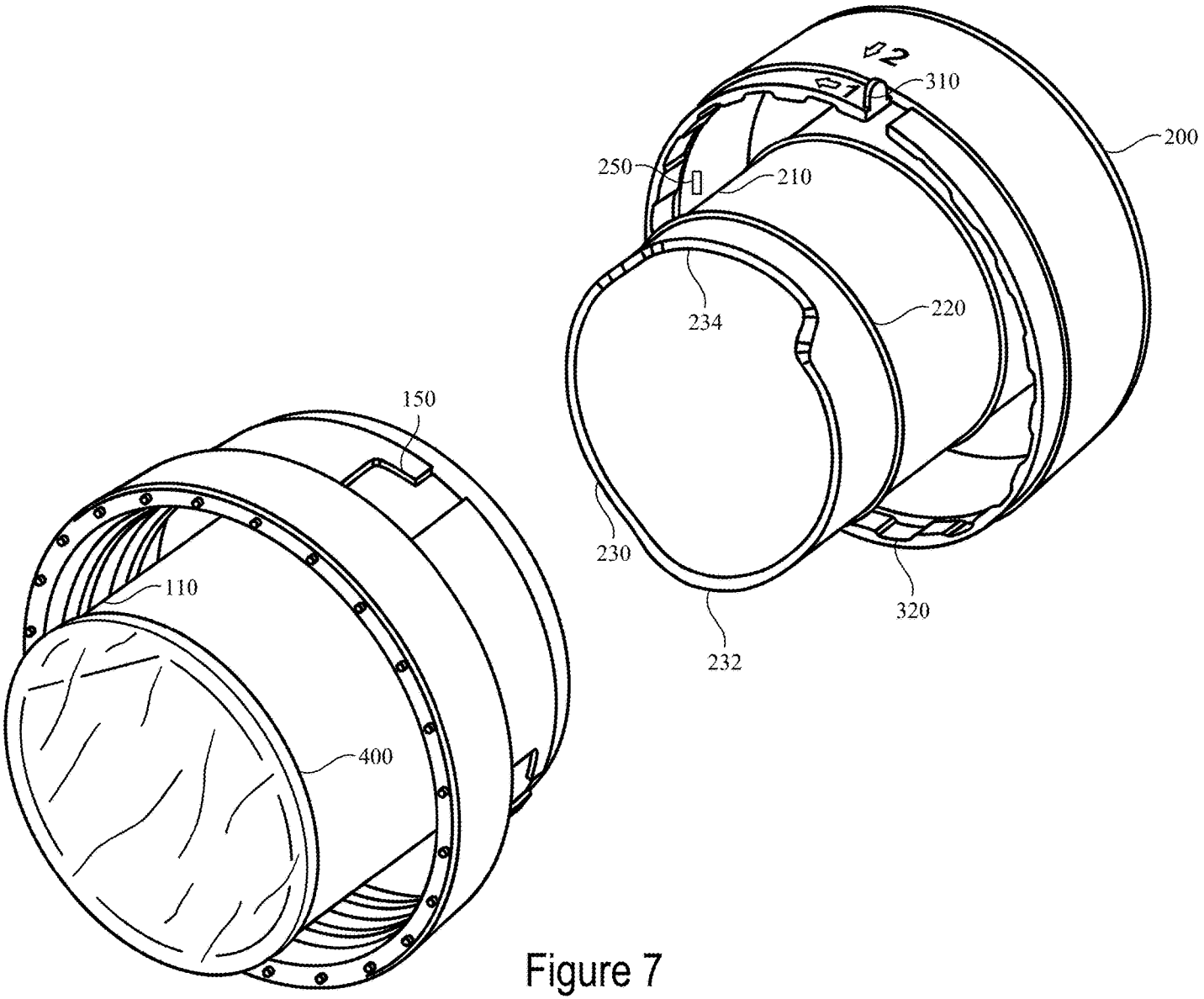
FIG. 7 illustrates a partially exploded perspective view of a cap device, in accordance with an embodiment of the present disclosure.

Referring briefly to FIG. 3B and FIG. 7, in some embodiments, an upper end portion of the lid 200 includes a first thickness (e.g., a wall thickness) and the spacer 300 includes a second thickness (e.g., wall thickness), which are either equal or unequal. In some embodiments, the interface 320 includes a third thickness that is different from the first thickness and/or the second thickness. In some embodiments, this third thickness of the interface 320 is less than the first thickness of the lid 200 and/or the second thickness of the spacer 300, creating a material weakness at the interface 320 for disengaging the spacer 300 from the lid 200 of the cap device 10.

Figure 2:
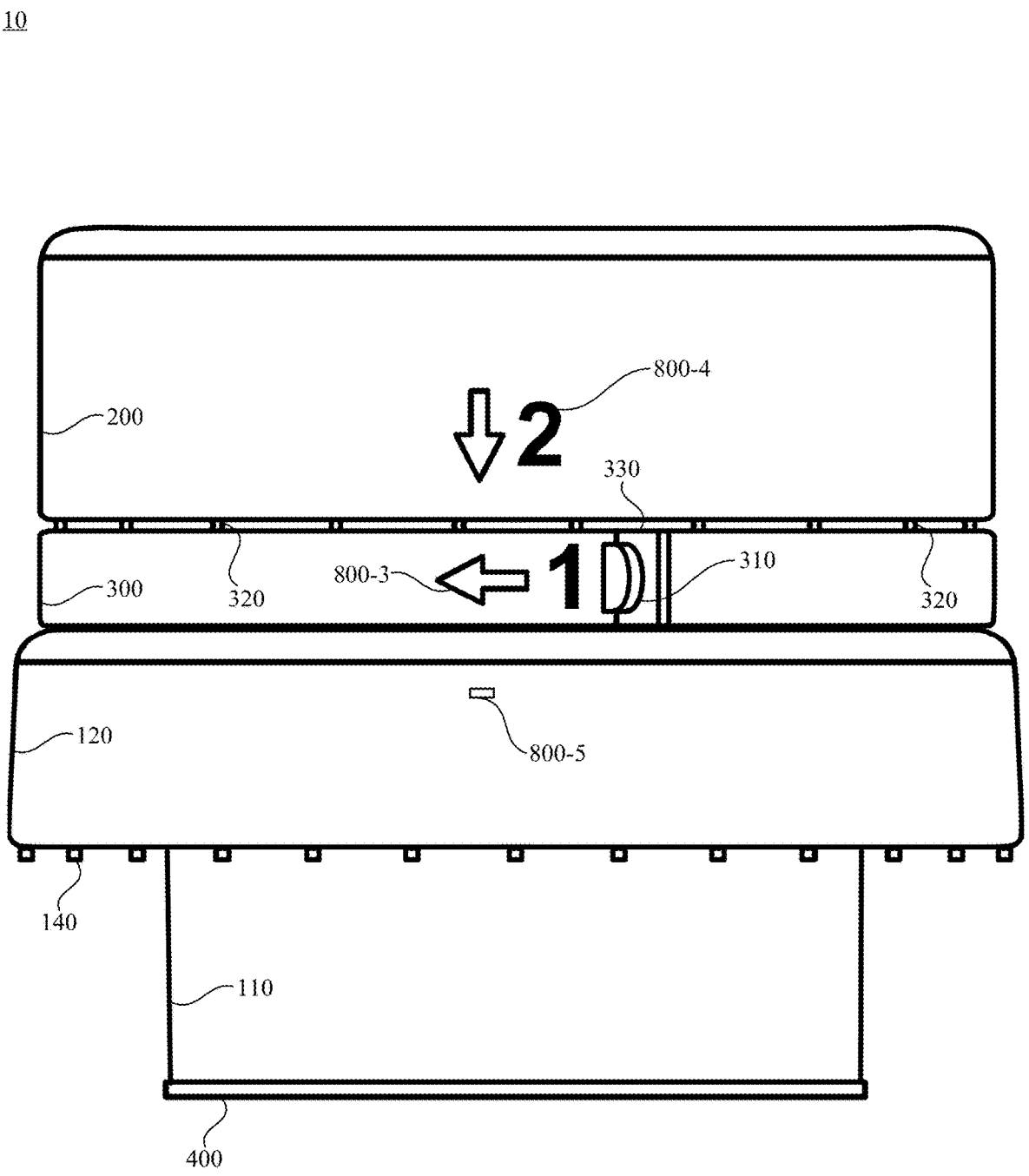
FIG. 2 illustrates a side view of a cap device, in accordance with an embodiment of the present disclosure.

Referring to briefly to FIG. 2, in some embodiments, the interface 320 includes a plurality of perforations interposing between the spacer 300 and the upper end portion of the lid 200. In some embodiments, the perforations of the interface 320 provide a material weakness (e.g., difference in strength) between the spacer 300 and the lid 200, allowing the spacer 300 to disengage from the lid 200. In some embodiments, the perforations of the interface 320 are as described with respect to the protrusions 140 of the skirt 120. In some embodiments, each perforation of the interface 320 extends from a lower end portion of the upper end portion of the lid 200 to the spacer 300 by a distance in a range of from 0.01 mm to 10 mm, from 0.01 mm to 5 mm, from 0.05 mm to 3 mm, from 0.1 mm to 3 mm, from 0.1 mm to 2 mm, from 0.1 mm to 1 mm, or from 0.3 mm to 0.7 mm. In some embodiments, each perforation of the interface 320 extends from a lower end portion of the upper end portion of the lid 200 to the spacer 300 by a distance of 0.5±0.4 mm (e.g., 0.50 mm).

In some embodiments, the exterior portion of the lid 200 includes a cylindrical portion of a third diameter (e.g., D3 of FIG. 3B). For instance, in some embodiments, a portion of the upper end portion of the lid 200 extends downwardly at a third diameter D3, which is greater than the first diameter D1 of the protrusion 210. In some embodiments, the third diameter D3 of the lid 200 is greater than the second diameter D2 of the opening 110 of the body 100, allowing the upper end portion of the opening 110 to be accommodated within an interior portion of the lid 200. In some embodiments, a diameter of the spacer 300 is in a range of from 60% to 100% of the third diameter D3 (e.g., D3 of FIG. 4A), from 65% to 100%, from 70% to 100%, from 75% to 100%, from 80% to 100%, from 85% to 100%, from 90% to 100%, or from 95% to 100% of the third diameter D3. In some embodiments, the above describes ranges for the dimeter of the spacer 300 include a maximum diameter to 99% of the third diameter D3 (e.g., from 75% to 99%, from 80% to 99%, etc.). In some embodiments, a diameter of the spacer 300 is in a range of from 100% to 300% of the second diameter D2 of the opening 110 (e.g., D2 of FIG. 4A), from 100% to 250%, from 100% to 200%, from 100% to 190%, from 100% to 180%, from 100% to 170%, from 100% to 160%, from 100% to 150%, from 100% to 140%, from 100% to 130%, from 100% to 120%, from 100% to 115%, from 100% to 110%, or from 100% to 105% of the third diameter D3 of the opening. In some embodiments, the above describes ranges for the dimeter of the spacer 300 include a minimum diameter from 101% of the second diameter D2 of the opening 110 (e.g., from 101% to 140%, from 101% to 130%, etc.).

Accordingly, in some embodiments, the spacer 300 is a cylindrical object of the third diameter D3 having a gap (e.g., gap 330 of FIG. 2) formed at a portion of a circumference of the spacer 300. For instance, in some embodiments, the spacer 300 as an annular object with the gap 330 formed at a portion of the circumference of the spacer 300. In some embodiments, this gap 300 defines a chord length of the cylinder formed by the spacer 300. Furthermore, in some embodiments, the spacer 300 includes an elastic material, such as a plastic material or a rubber material, allowing the spacer 300 to deform during transition between the first state and the second state. As such, in some embodiments, the length of the gap 330 varies depending on a state of the spacer 300 and/or during a transition between the states of the spacer 300. For instance, in some embodiments, the chord length of the gap 330 in the first state of the spacer 300 is less than the third diameter D3, such that the spacer 300 forms a snug or tight fit about a portion of the cap device 10 having the third diameter D3 (e.g., the lid 200). Accordingly, in some embodiments, the chord length of the gap 330 in the second state, or transitioning about the first state and the second state, of the spacer 300 is greater than or equal to the third diameter D3, such that the spacer 300 temporarily deforms to a diameter greater than the third diameter D3 allowing the spacer 300 to disengage, or similarly engage, the cap device 10.

In some embodiments, the lid 200 and the spacer 300 engage through corresponding magnetic fields. For instance, in some embodiments, each of the spacer 300 and the lid 200 each include one or more magnets disposed on, or imbedded within, corresponding surfaces, such as an upper surface of the spacer 300 and a lower surface of the lid 200.

In some embodiments, the lid 200 and the body 100 each include a corresponding mating mechanism (e.g., a second mating mechanism) that allow the lid 200 and the body 100 to engage with each other (e.g., block 1108 of FIG. 11). For instance, in some embodiments, the body 100 includes a second mating mechanism (e.g., second mating mechanism 150 of FIG. 5), and the lid 200 further includes a second mating mechanism (e.g., second mating mechanism 250 of FIG. 7). In some embodiments, the second mating mechanism 150 of the body 100 is disposed on external surface of the upper end portion of the opening 110. Moreover, in some embodiments, the upper end portion of the opening 110 having the second mating mechanism 150 includes a portion of the opening having then second diameter D2. In some embodiments, the second mating mechanism 150 of the body 100 and the second mating mechanism 250 of the lid 200 are as described with respect to the first mating mechanism of the container and the first mating mechanism 130 of the body 100, respectively. However, the present disclosure is not limited thereto.

Figure 10:
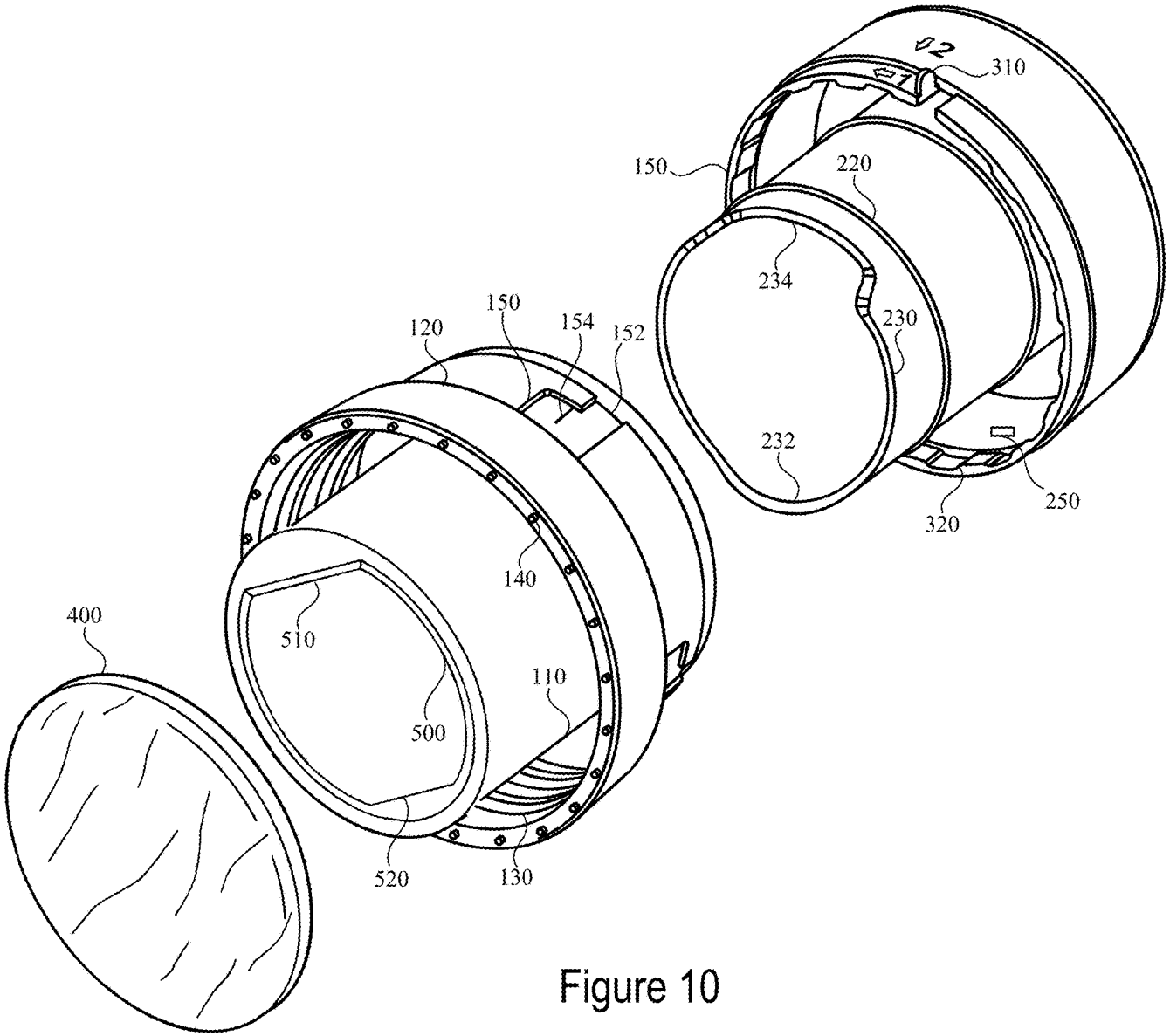
FIG. 10 illustrates another partially exploded perspective view of a cap device, in accordance with an embodiment of the present disclosure.

For instance, referring briefly to FIG. 7 and FIG. 10, in some embodiments, the second mating mechanism 250 of the lid 200 includes a protrusion extending inwardly (e.g., towards axis 160). As such, the second mating mechanism 150 of the body 100 includes a groove 152 configured to accommodate (e.g., receive) the protrusion of the second mating mechanism 250 of the lid 200. Furthermore, the groove 152 is configured to restrict movement of the protrusion of the second mating mechanism 250, such that the lid 200 and the body 100 are further restricted from one or more degrees of freedom. In some embodiments, the second mating mechanism 150 of the body 100 includes a protrusion 154, which assists in restricting the relative movement of the lid 200 and the body 100 of the cap device 10. In some embodiments, the protrusion 152 extends from a first edge portion of the groove 152 towards a second edge portion of the groove 152 opposite the first end portion. As illustrated in FIG. 7, in some embodiments, the protrusion 152 partially extends towards the second edge portion of the groove 152. This partial extension of the protrusion 152 allows the protrusion of the second mating mechanism 250 of the lid 200 to pass from a first side portion to a second side portion of the protrusion 152 via a void formed between an end portion of the protrusion 152 and the second edge portion of the groove 152.

Furthermore, in some embodiments, the second mating mechanism 150 of the body 100 includes a first number of grooves 152 and the second mating mechanism 250 of the lid 200 includes a second number of protrusions. In some embodiments, the second number of the second mating mechanism 250 of the lid 200 is greater than or equal to the first number of grooves 152 of the second mating mechanism 150 of the body 100. However, the present disclosure is not limited thereto. For instance, in some embodiments, the second number of the second mating mechanism 250 of the lid 200 is less than the first number of grooves 152 of the second mating mechanism 150 of the body 100. In some embodiments, the first number of grooves 152 of the second mating mechanism 150 of the body 100 and the second number of the second mating mechanism 250 of the lid 200 are in a range of from 1 to 20, from 1 to 15, from 1 to 10, from 1 to 8, from 1 to 7, from 2 to 8, from 3 to 6, from 3 to 5 (e.g., 4). As such, the second mating mechanism provide great flexibility in orienting and engaging the lid 200 and the body 100 together.

In some embodiments, if the lid 200 and the body 100 are engaged with each other, the lid 200 and the body 100 are movably relative to each other with at least one degree of freedom. In some embodiments, the lid 200 and the body 100 are restricted to one degree of freedom if in an engaged state. Moreover, in some embodiments, the one degree of freedom is a translational degree of freedom, such as a translational degree of freedom parallel to the axis 160 of FIG. 6. However, the present disclosure is not limited thereto.

Figure 6:
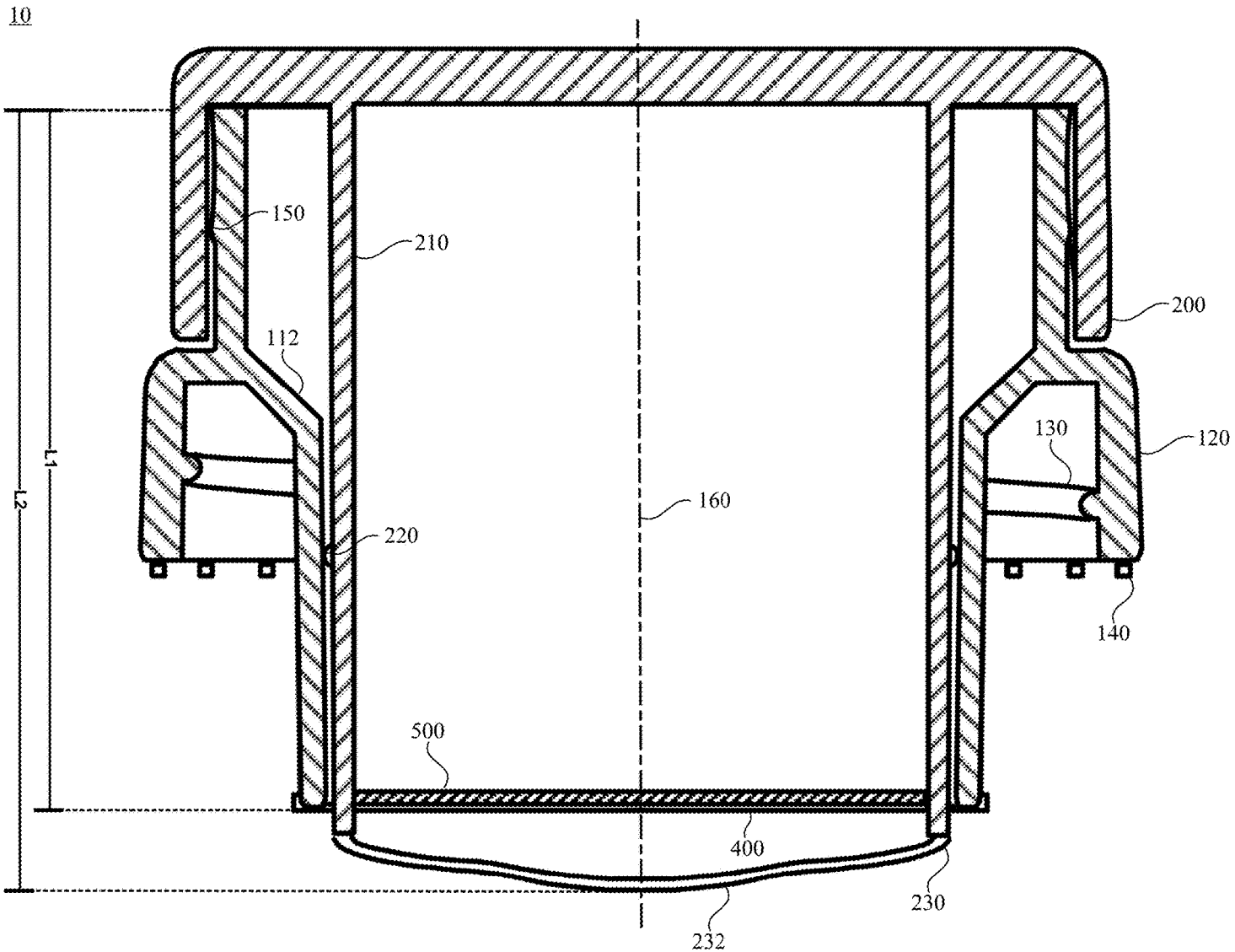
FIG. 6 illustrates a cross-sectional view of a cap device in a second state, where dashed lines are projections of a corresponding length, in accordance with an embodiment of the present disclosure.

For instance, in some embodiments, the engaging of the lid 200 and the body 100 allows for a relative movement between the lid 200 and the body 100 with the one translational degree of freedom (e.g., a translational degree of freedom parallel to the axis 160 of FIG. 6) and one rotational degree of freedom (e.g., a rotational degree of freedom orthogonal to the axis 160 of FIG. 6).

In some embodiments, the body 100 further includes a gate (e.g., gate 500 of FIG. 4A) disposed at a lower end portion of the body 100. The gate 500 is formed at the lower end portion of the opening 110 of the body 100 proximate to the membrane 400, allowing for the gate 500 to engage with the membrane 500 in accordance with a movement of the lid 200 from the first state to the second state.

Accordingly, the gate 500 is movable between a first position (e.g., a first position of gate 500 as illustrated in FIG. 5) and a second position (e.g., second position of gate 500 as illustrated FIG. 6). In the first state of the gate 500, the gate 500 occupies a first portion of the opening 110, such as a first portion of an inlet area of a lower end portion of the opening 110. As such, the gate 500 in the first position supports a load of the compound 500 that would otherwise be supported by the membrane 400. In some embodiments, the occupied area of the gate 500 is in a range of from 40% to 100% of the inlet area of the lower end portion of the opening 110, from 45% to 100%, from 50% to 100%, from 55% to 100%, from 65% to 100%, from 70% to 100%, from 75% to 100%, from 80% to 100%, from 85% to 100%, from 90% to 100%, or from 95% to 100% of the inlet area of the lower end portion of the opening 110.

The gate 500 in the second position occupies a second portion of the opening 110 that is less than the first portion. For instance, in some embodiments, the gate 500 rotates about a portion of the lower end portion of the opening 110 from the first state to the second state, such that the gate 500 no longer occupies the inlet area of the lower end portion of the opening 110. As such, the gate 500 assists the protrusion 210 of the lid 200 in disengaging the membrane 400 from the opening 110, providing improved dispensing of the compound 700.

In some embodiments, the gate 500 is internally disposed at the lower end portion of the opening 110 above the membrane 400 (e.g., as illustrated in FIG. 1, such that the load from the compound 700 forms an indentation 530 of the gate 500 on the membrane 400).

In some embodiments, a first end portion of the gate 500 (e.g., portion 510 of FIG. 10) is coupled to the lower end portion of the opening 110 and a second end portion of the gate 500 (e.g., portion 520 of FIG. 4A) is free from the opening 110. Moreover, in some embodiments, the first end portion of the gate 500 includes a portion 512 having a material weakness, such as a reduced thickness, providing a region for the gate 510 to rotate about. As such, the gate 500 acts as a hinge device rotating about the first end portion 510 of the gate. Referring to FIG. 4A, in some embodiments, the gate 500 is formed with one or more edges (e.g., edges 520), or corners, that assist in disengaging the membrane 400 from the opening 110. In some embodiments, the one or more edges 522 of the gate 500 are disposed at the first end portion 510 and/or the second end portion 520 of the gate. In some embodiments, the one or more edges 522 are formed about a circumference of the gate 500, such that the circumference of the gate 500 forms a serrated edge, which assists in piercing the seal of the membrane 400.

In some embodiments, a lower end portion of the protrusion 210 further includes a wedge (e.g., wedge 230 of FIG. 8) that is configured to pierce the sealing of the membrane 400 and/or abut a portion of the gate 500 (e.g., the first end portion 510 of the gate 500). In some embodiments, the wedge 230 is formed as a protrusion extending outwardly from an interior surface of the hallow 110. However, the present disclosure is not limited thereto. For instance, in some embodiments, the wedge 230 is formed from a circumference of the lower end portion of the protrusion 210. In some embodiments, the wedge 230 of the protrusion 210 includes a first edge (e.g., edge 232 of FIG. 9) at a first end portion of the wedge 230. This first edge 232 of the wedge 230 is formed with a smooth or blue shape, allowing the seal of the membrane 400 to be pierced without permanently deforming the membrane 400. However, the present disclosure is not limited thereto. For instance, in some embodiments, the first edge 232 of the wedge is formed including one or more sharp edges or tips. In some embodiments, the first edge 232 of the wedge 230 includes a maxima length of the opening 110, such that the first edge 232 of the wedge 230 is the first portion of the lid 200 to engage the membrane 400 while depressing the lid 200 further towards the body 100 (e.g., block 1114 of method 1100 of FIG. 11).

In some embodiments, the cap device 10 includes a metal material, a plastic material, a rubber material, or a combination thereof. For instance, in some embodiments, the body 100 and the lid 200 of the cap device 10 includes a plastic material configured for medical and/or pharmaceutical applications. Moreover, in some embodiments, a portion of the upper end portion of the lid 200 and/or the skirt 120 of the body 100 includes a rubber material, providing an improved grip for the user of the cap device 10. In some embodiments, the spacer 300 includes an elastic material (e.g., rubber), allowing the spacer 300 to elastically deforms during transition between states (e.g., elastically deform to disengage from the lid 200).

Now that details of a cap device 10 for accommodating and dispensing a compound 700 into a container have been disclosed, details regarding a flow chart of processes and features for implementing a method 1100 of utilizing the cap device 10, in accordance with an embodiment of the present disclosure, are disclosed with reference to FIG. 11.

Block 1102. Referring to block 1102 of FIG. 11, a cap device (e.g., cap device 10 of FIG. 10) is provided for dispensing a first compound 700-1 into a container. The cap device 10 includes a body (e.g., body 100 of FIG. 4B) and a lid (e.g., lid 200 of FIG. 3A), that removably engage to form the cap device 10. The body 100 includes an opening (e.g., opening 110 of FIG. 1) that is configured to accommodate a compound (e.g., compound 700 of FIG. 5). The lid 200 includes a protrusion (e.g., a hollow protrusion 210 of FIG. 210 of FIG. 5) extending downwardly from an upper end portion of the lid 200. In some embodiments, the protrusion 210 is configured to accommodate the compound 700, such as embodiments including a hollow protrusion. The cap device 10 further includes a spacer (e.g., spacer 300 of FIG. 2) that removably engages (e.g., removably coupled) with an upper end portion of the lid 200. Accordingly, the spacer 300 interposes between the upper end portion of the lid 200 and the body 100 of the cap device 10, which acts as a mechanical stopper preventing the lid from depressing further towards a portion the body 100 (e.g., an upper end portion of the skirt 120 of the body 100). Furthermore, the spacer 300 allows the cap device 10 to transition from the first stage to the second stage without requiring an intermittent stage (e.g., a rotational stage), providing an improved operation for a user of the cap device 10 (e.g., block 1114 of FIG. 11).

Block 1104. The method 1100 includes sealing a lower end portion of the opening 110 of the body 100. For instance, in some embodiments a membrane (e.g., membrane 400 of FIG. 1) engages with the lower end portion of the opening 110, sealing the opening 110. In some embodiments, an adhesive material is disposed on an upper surface of the membrane 400, allowing the membrane 400 to removably engage with the lower end portion of the opening 110. In some embodiments, the sealing the lower end portion of the opening 110 includes positioning a gate (e.g., gate 500 of FIG. 4A) in a first state, such that the gate occupies a portion of an inlet area of the lower end portion of the opening 110. This sealing of the lower end portion of the opening 110 not only provides isolation for a compound 700 from contaminates, but also allows for the cap device 10 to engage a container without having the compound 700 prematurely dispensing the compound 700.

Block 1106. Once the lower end portion of the opening 110 is sealed (e.g., the membrane 400 engages the lower end portion of the opening 110), either of the opening 110 or the hollow of the protrusion 210 is filled with a first dosage of the first compound 700-1.

In some embodiments, an internal surface of one of the opening or the hollow protrusion of the cap further includes one or more indicia (e.g., indicia 800 of FIG. 5). Each respective indicia defines a unique predetermined dosage, such as unique volumes of fluids that correspond to varying dosages. Accordingly, the filling of the cap device 10 with a compound 700 includes filling the one of the opening 110 or the protrusion 210 to one of the indicia of various indicia 800 with the compound 700. As such, the user is provide with a proved mechanism for measuring dosages of compounds 700.

In some embodiments, the opening 110 and/or the protrusion 210 includes a first diameter at a lower end portion (e.g., D1 of FIG. 5) and a second diameter, greater than the first diameter, at an upper end portion (e.g., D2 of FIG. 5), which forms a funnel for improved dispensing of the first dosage of the first compound 700-1 into the cap device 10, or optionally, improved flow of the first compound 700-1 from the cap device 10 into the container. In some embodiments, the above funnel is formed as a transition region (e.g., transition region 112 of FIG. 5) from the first diameter D1 to the second diameter 112, which provides the above improved dispensing and flow.

Furthermore, in some embodiments, depending on which portion of the cap device 10 receives the compound 700, the method 1110 conducts the engaging of block 1106 prior to the sealing of block 1104. For instance, in some embodiments, the protrusion 210 receives the compound 700 instead of the opening 110, allowing the sealing of the lower end portion of the opening 110 to be conducted after the disposing of the compound 700 into the protrusion 210 of the lid 200.

Block 1108. The lid 200 and the body 100 of the cap device 10 are engage by accommodating the protrusion 210 of the lid 200 within a portion of the opening 110 of the body 100. With the lid 200 and the body 100 engaged, the first compound 700-1 in accommodated with in the cap device 10. In this engaged state of the lid 200 and the body 100, the first compound 700 is prevented from escaping the device 10 unless, for instance, the lid 200 and the body 100 are disengaged or the cap device 10 is otherwise altered (e.g., disengaging the spacer 300 of the cap device 10, such as block 1312 of the method 1100 of FIG. 11).

In some embodiments, the spacer 300 is coupled to the upper end portion of the lid 200 prior to engaging the lid 200 and the body 100 (e.g., prior to block 1308 of the method 1100 of FIG. 11).

In some embodiments, the engaging of the lid 200 and the body 100 further includes coupling the spacer to the upper end portion of the lid. In some embodiments, the engaging of the lid 200 and the body 100 allows a relative movement between the lid and the body with one translational degree of freedom. In some embodiments, the engaging of the lid 200 and the body 100 allows a relative movement between the lid and the body with one translational degree of freedom.

In some embodiments, this state of the spacer 300 engaged with the cap device 10 restricts a relative movement between the lid 200 and the body 100 to one degree of freedom. In some embodiments, this restricted one degree of freedom is a translational degree of freedom parallel to a longitudinal axis of the cap device 10 (e.g., axis 160 of FIG. 5). In some embodiments, this restricted one degree of freedom is a rotational degree of freedom orthogonal to the longitudinal axis of the cap device 10 (e.g., axis 160 of FIG. 5).

In some embodiments, a first force is required for the engaging the lid 200 and the body 100 (e.g., a force required for conducting block 1108 of the method 1100), while a second force is required for piercing the seal of the membrane 400 by the depressing of the lid 200 (e.g., a force required for conducting block 1114 of the method 1100). In some embodiments, the first force is less than or equal to the second force. Since the second force required for piercing the seal of the membrane 400 is relatively small (e.g., easily applied by an user of the cap device 10), the lid 200 and the body 100 are easily disengage with minimal effort by the user of the cap device 10, providing reusability of the cap device 10.

Block 1110. A lower end portion of the body 100 and the container engage, such that the cap device 10 is coupled to the container. In some embodiments, the engagement between the body 100 and the container is facilitated through corresponding mating mechanisms (e.g., first mating mechanism 130 of the body 100). For instance, in some embodiments, engaging the body 100 and the container includes receiving an upper end portion of the container (e.g., a mouth) at an internal portion of the body 100, such as the skirt 120. In some embodiments, one or more protrusions (e.g., protrusions 140 of FIG. 6), engage an upper end portion of the container upon engaging the cap device 10 and the container.

Block 1112. The spacer 300 is disengaged from the upper end portion of the lid 200. In some embodiments, the spacer 300 includes a mechanism (e.g., mechanism 310 of FIG. 2), that provides the user of the cap device 10 an improved grip for disengaging the spacer 300 and the lid 200. In some embodiments, this disengagement of the spacer 300 from the lid 200 includes deforming an interface (e.g., interface 320 of FIG. 2) formed between the spacer 300 and the lid 200 or removably coupling the spacer from the lid 200. For instance, in some embodiments, the interface 320 includes one or more protrusions that fracture through the disengaging the spacer 300 from the lid 200.

Block 1114. With the spacer 300 disengaged from the cap device 10, the lid 200 is allowed to depress further towards to the body 100. If a user applies a force on the lid 200, the protrusion 210 depresses towards the lower end portion of the opening, piercing the seal formed by the membrane 400. Accordingly, the dosage of the first compound 700-1 is free to escape the cap device 10 and dispense into the container.

In some embodiments, the protrusion 210 engages with the gate 500, which in turn engages and pierces the seal of the membrane 400. In some embodiments, the wedge 230 of the protrusion 210 engages with the gate 500, reducing a force the user must apply to pierce the seal of the membrane 400. For instance, in some embodiments, the second end portion 520 of the wedge 230 rotates about the first end portion 510, which is coupled to the lower end portion of the opening 110, amplifying a force applied from the protrusion 210 towards the membrane 400.

In some embodiments, the penetrating the membrane 400 punctures the membrane 400, reducing the structural integrity of the membrane 400. In some embodiments, the puncturing of the membrane 400 forms one or more through holes on the membrane 400, allowing the membrane 400 to remain engaged with the lower end portion of the body 100 while also permitting the dispensing of the compound 700 from the cap device 10 into the container. In some embodiments, the penetrating the membrane 400 removes, or decouples, at least a portion of the membrane 400 from the lower end portion of the body 100. For instance, in some embodiments, a first portion of the membrane 400 proximate to the first edge 232 of the wedge 230 disengages from the lower end portion of the opening 110, while a second portion of the membrane 400 proximate to the second edge 234 of the wedge 230 remains engaged with the lower end portion of the opening 110 during the depressing of the lid 200. As such, the membrane 400 remains partially engaged with the lower end portion of the body 100, allowing the compound 700 to dispense from the cap device 10 to the container without having the membrane 400 also dispense (e.g., fall into) the container).

Block 1116. In some embodiments, the method 1100 further includes decoupling the cap device 10 from the container upon dispensing the compound 700 into the container. In some embodiments, a period of time elapses prior to the decoupling of the cap device 10 from the container, allowing for the compound 700 and a solvent (including, for example, a consumable liquid) to completely react (e.g., completely dissolve the compound 700). The complete reaction can form a consumable solution.

In some embodiments, the container includes a consumable liquid (e.g., a solution including a solute compound 700 and a solvent of the container). As such, the decoupling of the cap device 10 from the container 10 further includes decoupling the body 100 and the lid 200 of the cap device 10. Accordingly, in some embodiments, the user decouples the lid 200 from the cap device 10 prior to decoupling the body 100 from the container. As such, prior to the decoupling of either of the body 100 from the container or the lid 200 from the body 100, the method 1100 further includes consuming the solution of the compound 700. For instance, in some embodiments, the upper end portion of the opening 110 forms a mouth for the user for the cap device 10 to utilizing while conducting the consumption of the solution.

Accordingly, in some embodiments, the method 1100 further includes repeating the sealing of the membrane 400 (e.g., block 1104 of FIG. 11) through the depressing (e.g., block 1114 of FIG. 11) of the lid 200 of the method 1100 for either a second dosage of the first compound 700-1 (e.g., a further dosage of a previously dispensed compound 700) or a first dosage of a second compound 700-2. As such, the cap device 10 is reusable with a multitude of different compounds 700 and dosages of each respective compound 700 according to a selection of the user. In some embodiments, this repeating of the sealing through the depressing of the method 1100 includes sanitizing a portion of the cap device 10 prior to the sealing of this repeating of the method 1100.

In some embodiments, the sealing the lower end portion of the opening 110 using the membrane 400 includes removing the pierced first membrane 400-1 from lower end portion of body 100. In some embodiments, the sealing the lower end portion of the body 100 of the repeating includes resealing the lower end portion of the opening of the body with the membrane, thereby reforming the pierced seal. Accordingly, the membrane 400 is reusable for more than one sealing and dispensing operation of the cap device 10. With the first membrane 400-1 disengaged from the cap device 10, a second membrane 400-2 different from the first membrane 400-1 is applied to the cap device 10, allowing for further disposal of a second compound 700-2 into the cap device 10 (e.g., repeating block 1106 of FIG. 11).

In some embodiments, the repeating of a dispensing of a compound 700 omits the removing of the membrane 400. For instance, in some embodiments, the gate 500 is repositioned to the first position, which seals the lower end portion of the opening 110.

In some embodiments, the spacer 300 is integrally formed with the upper end portion of the lid 200. Accordingly, the method 11000 further includes decoupling both the body 100 from the container and the lid 200 from the body 100 (e.g., disengaging the components of the cap device 10). Further, in some embodiments, the method 1100 includes repeating the sealing of the membrane 400 (e.g., block 1104 of FIG. 11) through the depressing (e.g., block 1114 of FIG. 11) of the method 1100 with a second lid 200-2 different from the lid 200 used for the dispensed compound 700-1 and/or a second body 100-2 different from the body 100 used for the dispensed compound 700-1. This second lid 200-2 and/or second body 100-2 removes any contamination issues that arise during the repeating of the dispensing of a second compound 700-2 if the first lid 200-1 and/or the first body 100-1 are not properly sterilized.

REFERENCES CITED

All referenced cited herein are incorporated herein by reference in their entirety and for all purposes to the same extent as if each individual publication or patent or patent application was specifically and individually indicated to be incorporated by reference in its entirety for all purposes.

What is claimed is:

1. A cap configured for accommodating and dispensing a compound into a container, the cap comprising:

a body comprising:

an upper end portion, a lower end portion, an opening defining a volume configured for accommodating the compound, the opening penetrating through a central axis of the body by a first length from the upper end portion to the lower end portion of the body, a gate disposed at the lower end portion of the body, wherein the gate is movable between a first position, in which the gate occupies a first portion of the opening, and a second position, in which the gate occupies a second portion of the opening, and a membrane disposed at a lower end portion of the opening, wherein the membrane comprises a diameter greater than a diameter of the opening, thereby sealing the lower end portion of the opening; and a lid removably coupled and moveable relative to the upper end portion of the body, the lid comprising:

an upper end portion comprising an exterior surface and an interior surface, a protrusion extending downwardly from the interior surface of the lid by a second length greater than the first length of the opening of the body, wherein a diameter of the protrusion corresponds to the diameter of the opening, wherein the protrusion further comprises a gasket interposing between an inner surface of the opening of the body and an outer surface of the protrusion, and wherein the opening of the body accommodates a lower end portion of the protrusion, and a spacer removably coupled to the upper end portion of the lid and interposing between the upper end portion of the lid and the upper end portion of the body, wherein the spacer comprises a third length and is configurable between:

a first state in which the spacer is engaged with the lid, thereby increasing a distance between the upper end portion of the lid and the lower end portion of the opening by the third length, preventing the protrusion from penetrating the membrane, and a second state in which the spacer is disengaged with the lid, thereby removing the third length from the distance between the upper end portion of the lid and the lower end portion of the opening, allowing the protrusion of the lid to penetrate the membrane of the body.

2. The cap of claim 1, wherein the opening of the body comprises a first diameter at an upper end portion of the opening and a second diameter at a lower end portion of the opening, and wherein the diameter of the protrusion corresponds to the second diameter of the opening.

3. The cap of claim 1, wherein the lid is moveable relative to the body in a substantially straight line about a first translational degree of freedom parallel the central axis of the body.

4. The cap of claim 1, wherein:

the spacer is integrally formed with the lid; and an interface between the spacer and the lid comprises a first thickness less than a second thickness of the spacer or the lid.

5. The cap of claim 4, wherein the interface comprises a plurality of perforations.

6. The cap of claim 1, wherein:

the exterior portion of the lid comprises a cylindrical portion of a third diameter, and the spacer is a cylinder of the third diameter having a gap at a portion of a circumference of the cylinder, wherein the gap defines a chord length of the cylinder, and wherein:

the chord length of the gap in the first state of the spacer is less than the third diameter; and the chord length of the gap in the second state of the spacer is greater than or equal to the third diameter.

7. The cap of claim 1, wherein an exterior surface of the upper end portion of the body and the interior surface of the upper end portion of the lid comprise a corresponding mating mechanism.

8. The cap of claim 7, wherein the corresponding mating mechanisms of the body and the lid allow the cap to be configurable between:

a first state in which the body and the lid are free to couple and decouple with each other; and a second state in which the body and the lid are prevented from decoupling with each other.

9. The cap of claim 1, wherein the gate is internally disposed at the lower end portion of the opening above the membrane.

10. The cap of claim 1, wherein a first end portion of the gate is coupled to the lower end portion of the opening, and a second end portion of the gate is free.

* * * * *